US010419846B2

(12) United States Patent
Hayes

(10) Patent No.: US 10,419,846 B2
(45) Date of Patent: Sep. 17, 2019

(54) ACOUSTICAL DIFFUSION MANIFOLD

(71) Applicant: ACOUSTIC 3D HOLDINGS LTD, Brisbane, QLD (AU)

(72) Inventor: Joseph Hayes, Wyberba (AU)

(73) Assignee: ACOUSTIC 3D HOLDINGS LTD, Brisbane, QLD (AU)

( * ) Notice: Subject to any disclaimer, the term of this patent is extended or adjusted under 35 U.S.C. 154(b) by 0 days.

(21) Appl. No.: 15/571,707

(22) PCT Filed: May 5, 2016

(86) PCT No.: PCT/AU2016/000154
§ 371 (c)(1),
(2) Date: Nov. 3, 2017

(87) PCT Pub. No.: WO2016/176716
PCT Pub. Date: Nov. 10, 2016

(65) Prior Publication Data

US 2018/0160220 A1 Jun. 7, 2018

(30) Foreign Application Priority Data

May 7, 2015 (AU) ..... 2015901657

(51) Int. Cl.
*H04R 1/30* (2006.01)
*H04R 1/28* (2006.01)
(Continued)

(52) U.S. Cl.
CPC ..... *H04R 1/2857* (2013.01); *G10K 11/002* (2013.01); *G10K 11/22* (2013.01)

(58) Field of Classification Search
CPC ..... H04R 1/28; H04R 1/2807; H04R 1/30; H04R 1/2861; H04R 1/2865; H04R 2201/34
(Continued)

(56) References Cited

U.S. PATENT DOCUMENTS 2,127,110 A * 8/1938 Farrand ..... H04R 1/345 381/342
6,016,353 A * 1/2000 Gunness ..... H04R 1/345 181/145
(Continued)

FOREIGN PATENT DOCUMENTS

| | | |
|---|---|---|
| GB | 403843 | 1/1934 |
| WO | 2012051650 | 4/2012 |
| WO | 2015170297 | 11/2015 |

OTHER PUBLICATIONS

International Search Report for PCT/AU2016/000154, Completed by the Australian Patent Office on Jun. 10, 2016, 4 Pages.

*Primary Examiner* — Suhan Ni
(74) *Attorney, Agent, or Firm* — Polsinelli PC

(57) ABSTRACT

An acoustical diffusion manifold transducer system which includes: a surface having a plurality (N or N2), where N is an odd prime number) of acoustical channels arranged in an N jc1 or N×N matrix; and each acoustic channel driven by a loudspeaker driver and each channel length governed by the relationship Ti·j=[(i2+j2)rem N]*unit delay. Where T is delay between channels having sequential values in the number sequence and N is a prime number. The channels are arranged to end in an outlet device so that sound waves from the speaker driver arrive in an ordered sequence, the outlet of each channel has the same area. The channels are pathways for sound waves generated by the loudspeaker driver and are preferably enclosed tubes of any suitable cross section.

16 Claims, 23 Drawing Sheets

(51) Int. Cl.
*G10K 11/22* (2006.01)
*G10K 11/00* (2006.01)

(58) Field of Classification Search
USPC ..... 381/337–343
See application file for complete search history.

(56) References Cited

U.S. PATENT DOCUMENTS

| | | | | |
|---|---|---|---|---|
| 7,650,006 | B2 * | 1/2010 | Isotalo | H04R 1/30 181/142 |
| 8,798,303 | B2 * | 8/2014 | Hsu Huang | H04R 1/30 381/340 |
| 8,824,717 | B2 * | 9/2014 | Adams | H04R 1/403 381/337 |
| 9,282,398 | B2 * | 3/2016 | Monroe | H04R 1/22 |
| 2003/0132056 | A1 | 7/2003 | Meyer et al. | |
| 2013/0322635 | A1 | 12/2013 | Ma | |

* cited by examiner

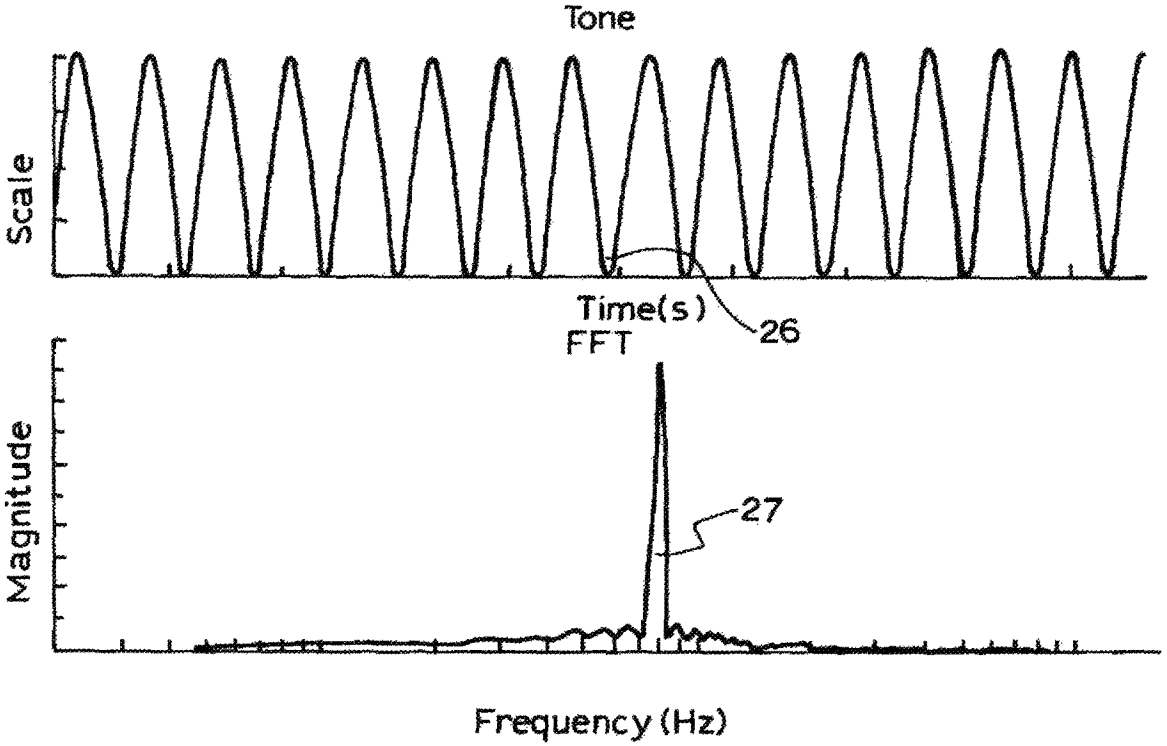
FIG. 31
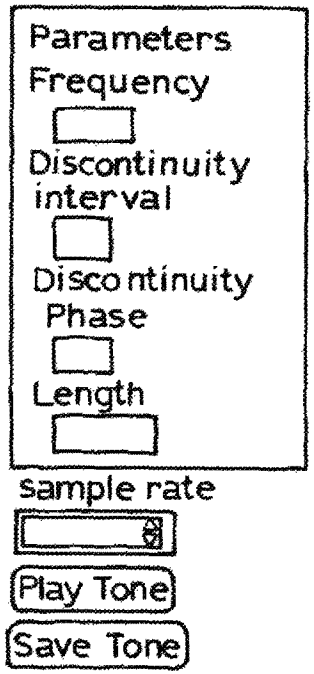

ACOUSTICAL DIFFUSION MANIFOLD

CROSS-REFERENCE TO RELATED APPLICATION

This application is the U.S. national phase of PCT Application No. PCT/AU2016/000154 filed on May 5, 2016, which claims priority to AU Patent Application No. 2015901657 filed on May 7, 2015, the disclosures of which are incorporated in their entirety by reference herein.

The present invention relates to an acoustical arrangement, and in particular, to an acoustical arrangement that provides a means of generating diffuse waves within a fluid space. In particular this invention is directed to laud speaker arrangements adapted to generate diffuse waves.

BACK GROUND TO THE INVENTION

WO2012015850 discloses a reflector and other arrangements for generating diffuse waves within a fluid space to clarify energy and heighten specific information in the space which carries a sound signal. In part there is a brief disclosure of a manifold. Some speaker drivers show a significant acceleration of the movement of the apparent acoustic centre at very high frequencies. The acoustic centre will start to move rapidly towards the voice coil of the driver above 10 kHz.

Some designs of the acoustic reflector embodiments disclosed in WO2012015650 are prone to acoustic centre geometric movements and had to be accommodated for such movements.

It is an object of this invention to provide improvements in the invention disclosed in WO2012015650.

BRIEF DESCRIPTION OF THE INVENTION

The present invention provides an acoustical diffusion manifold transducer system which includes:

a surface having a plurality (N or N2), where N is an odd prime number) of acoustical channels arranged in an N×1 or N×N matrix; and each acoustic channel driven by a loudspeaker driver and each channel length governed by the relationship $$Ti{\cdot}j=[(i2+j2)\text{rem } N]^{*}\text{unit delay.}$$

Where T is delay between channels having sequential values in the number sequence and N is a prime number.

The channels are arranged to end in an outlet device so that sound waves from the speaker driver arrive in an ordered sequence. The outlet of each channel has the same area. The channels are pathways for sound waves generated by the loudspeaker driver and are preferably enclosed tubes of any suitable cross section.

Preferably the cross sectional area of each pathway is the same but the length of the pathway is determined by the algorithm for achieving diffusion.

Preferably the number sequence used in the acoustical diffusion manifold is selected, from a Quadratic Residue Sequence, a Barker code, an auto-correlation sequence or a complementary sequence.

Other suitable number sequences are those used in signal processing such as a Barker code, a zero auto-correlation sequence or a complementary sequence.

A Barker code is a sequence of N values of +1 and −1, $a_j$ for j=1, 2, . . . , N such that $$\left|\sum_{j=1}^{N-v} a_j a_{j+v}\right| \leq 1$$

for all 1≤v<N.

Autocorrelation is the cross-correlation of a signal with itself. Informally, it is the similarity between observations as a function of the time separation between them. It is a mathematical tool for finding repeating patterns, such as the presence of a periodic signal which has been buried under noise, or identifying the missing fundamental frequency in a signal implied by its harmonic frequencies. It is often used in signal processing for analyzing functions or series of values, such as time domain signals.

Complementary sequences (CS) derive from applied mathematics and are pairs of sequences with the useful property that their out-of-phase aperiodic autocorrelation coefficients sum to zero. Binary complementary sequences were first introduced by Marcel J. E. Golay in 1949. In 1961-1962 Golay gave several methods for constructing sequences of length $2^N$ and gave examples of complementary sequences of lengths 10 and 26. In 1974 R. J. Turyn gave a method for constructing sequences of length mn from sequences of lengths m and n which allows the construction of sequences of any length of the form $2^N 10^K 26^M$.

BRIEF DESCRIPTION OF THE DRAWINGS

FIG. 31—is a graphical view of a tone and its Fast Fourier Transform;

DETAILED DESCRIPTION OF PREFERRED EMBODIMENTS OF THE INVENTION

Figure 1:
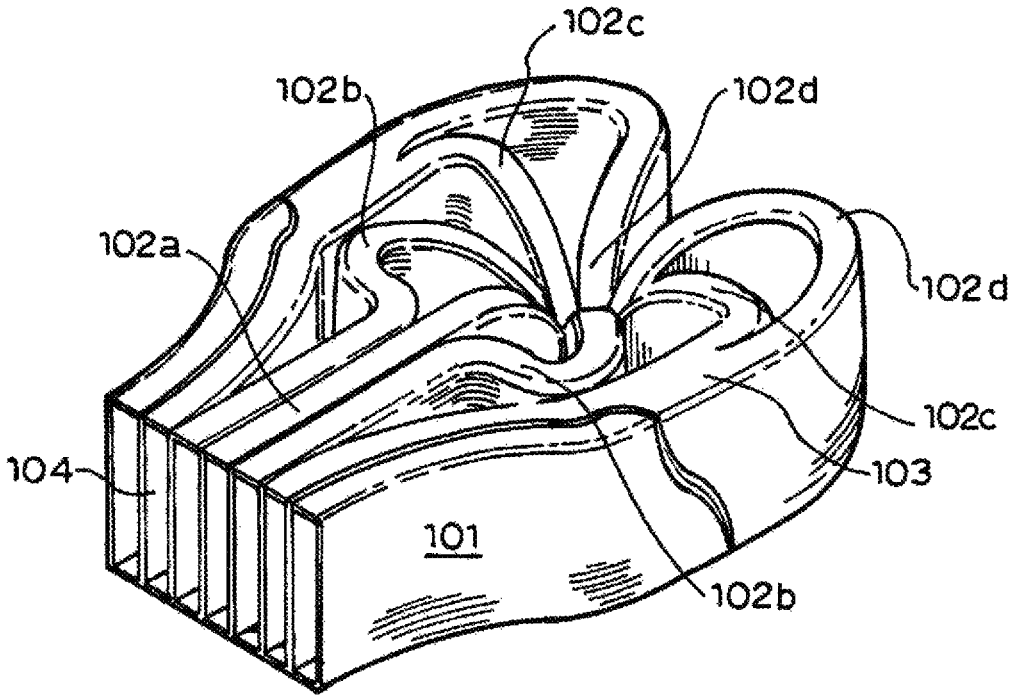
FIG. 1 shows an isometric view of an acoustic manifold.
Figure 2:
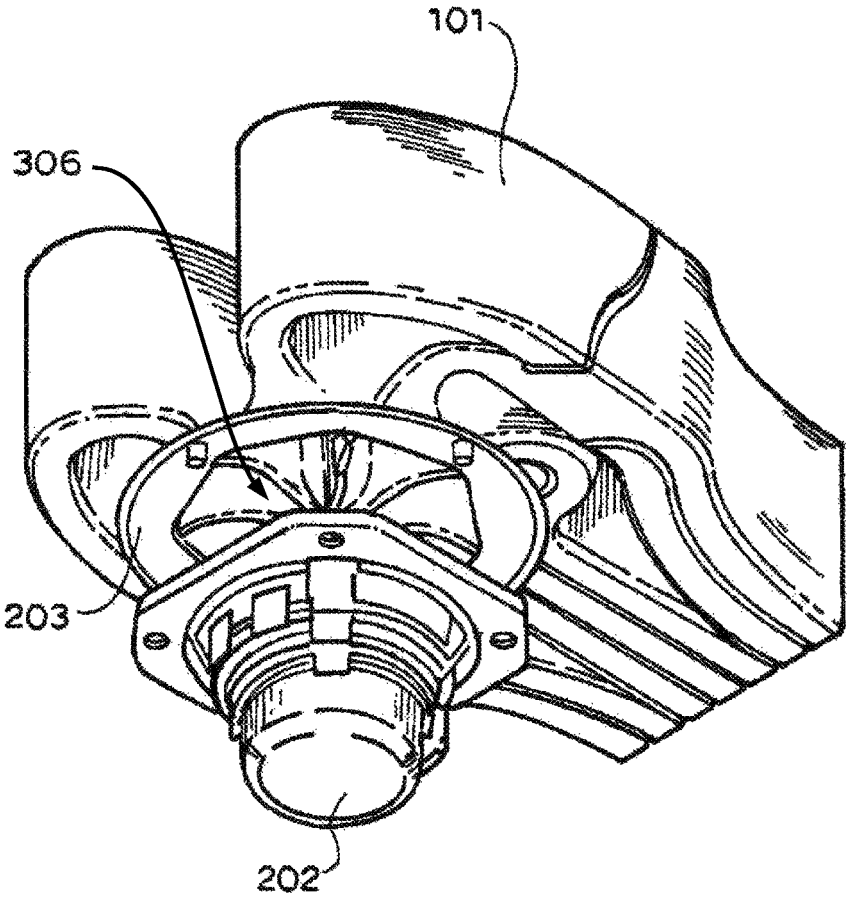
FIG. 2 is an isometric view of a loudspeaker driver and acoustical diffusion manifold.

FIGS. 1 to 4 show a manifold according to an exemplary embodiment, the manifold being part of acoustical diffusion manifold transducer system shown in FIG. 2. FIG. 1 shows an isometric view of an acoustical diffusion manifold 101 comprising 7 sectors (in other words, "acoustical pathways") that, in this embodiment, are sector 102*a*, two sectors 102*b*, two sectors 102*c*, and two sector 102*d* All 7 sectors 102*a*, 102*b*, 102*c*, 102*d* have outlet ends that arrive at an outlet 104 of the manifold 101 in an N×1 array (so as to form a sequence of 7 elements). The manifold 101 includes a twister portion 103 within which two sector pairs 102*c*, 102*d* swap positions laterally with respect to the N×1 array.

The length of each acoustical pathway, or "sector" 102*a*, 102*b*, 102*c*, 102*d* is determined by the solutions of a quadratic residue sequence (hereinafter "QRS", or alternatively quadratic residue difference "QRD") to which a constant offset distance is added, such that the length of each sector 102*a*, 102*b*, 102*c*, 102*d* is a compromise of layout that accommodates both the sector distance variation requirement to satisfy the QRD design and the ergonomics of practical construction.

The solution to the QRD determines the relative length variation between sectors to be in the sequence 2, 4, 1, 0, 1, 4, and 2 at the outlet 104. The relative position within the natural 7 sectors of the hard on collider is 4, 2, 1, 0, 1, 2, and 4. It is therefore requisite that the outer elements representing the '2' and '4' elements swap past each other along the pathway from the hard on collider to the outlet.

FIG. 2 is an isometric view of a loudspeaker driver 202 and the acoustical diffusion manifold 101 of FIG. 1, showing the coupling positioning of the two components. As is evident from FIG. 2, the manifold 101 is coupled to the driver 202 at the manifold inlet 203. As is shown in FIG. 2, the manifold 101 includes a splitter 306 (also referred to herein as the 'hard on collider'). The role of the 'hard on collider' is to direct the acoustic wave generated by the piston motion of the loudspeaker driver into the seven sectors, and thus to separate the acoustical energy from the driver 202 into 7 (or N) equal but individual acoustic waves that then travelling along the respective sector channels. This should be achieved without causing distortion or reflections of acoustical energy. Therefore consideration should be given to maintaining the cross sectional area and general acoustical wave guide design methods in specifying this portion.

One such mathematical number sequence which can produce a diffuse wave response with auto-correlation equal to zero is known as a Quadratic Residue Sequence (QRS). The QRS is a number sequence determined by subtracting multiple "N" from the quadratic (i.e. the second power) of the element in the sequence, in which "N" is an odd prime number (e.g., 1, 3, 5, 7, 11, 13, 17, 19, 23, 29 . . . ). In its application to the acoustical diffusion manifold 101. N is the number of sectors in the manifold 101. The individual element solutions are governed by the relationship:

$S_n = n^2$ rem N (i.e. the least non negative remainder resulting when subtracting multiple N from $n^2$)

Table 1 shows the solutions to a QRS in which N=7, for elements 0 to 13 in the sequence:

TABLE 1

| Element Number | Element No. Squared ($n^2$) | QRS Solution ($n^2$ rem N = $S_n$) |
|---|---|---|
| 0 | 0 | 0 rem 7 = 0 |
| 1 | 1 | 1 rem 7 = 1 |
| 2 | 4 | 4 rem 7 = 4 |
| 3 | 9 | 9 rem 7 = 2 |
| 4 | 16 | 16 rem 7 = 2 |
| 5 | 25 | 25 rem 7 = 4 |
| 6 | 36 | 36 rem 7 = 1 |
| 7 | 49 | 49 rem 7 = 0 |
| 8 | 64 | 64 rem 7 = 1 |
| 9 | 81 | 81 rem 7 = 4 |
| 10 | 100 | 100 rem 7 = 2 |
| 11 | 121 | 121 rem 7 = 2 |
| 12 | 144 | 144 rem 7 = 4 |
| 13 | 169 | 169 rem 7 = 1 |

It is the property of the QRS that any one period (of N adjacent elements) of the sequence can be used to achieve the diffuse wave function. Thus, the sequence can start at any number n, or fraction thereof, so long as it resolves one complete cycle of the sequence, i.e. Nw in periodic width (where w is the width of a well). The following Table 2 starts at n=4 and includes n=10 such that there are seven elements in this period of the sequence, and N=7 elements.

TABLE 2

| Element Number | Element No. Squared ($n^2$) | QRS Solution $S_n$ (= $n^2$ rem N) |
|---|---|---|
| 4 | 16 | 2 |
| 5 | 25 | 4 |
| 6 | 36 | 1 |
| 7 | 49 | 0 |
| 8 | 64 | 1 |

TABLE 2-continued

| Element Number | Element No. Squared ($n^2$) | QRS Solution $S_n$ (= $n^2$ rem N) |
|---|---|---|
| 9 | 81 | 4 |
| 10 | 100 | 2 |

The following Table 3 starts at n=2 and includes n=6 10 such that there are five elements in this period of the sequence, and N=5 in the QRS. The solution 4, 1, 0, 1, 4 happens to also appear nested inside the solution of 2, 4, 1, 0, 1, 4, 2 of table 2. It is a property of the QRS that solution for lower prime numbers appear nested inside higher prime number solutions.

TABLE 3

| Element Number | Element No. Squared ($n^2$) | QRS Solution $S_n$ (= $n^2$ rem N) |
|---|---|---|
| 2 | 4 | 4 |
| 3 | 9 | 1 |
| 4 | 16 | 0 |
| 5 | 25 | 1 |
| 6 | 36 | 4 |

If a set of solutions $S_n$ for any N, do not suit an application, a constant, can be added to each solution $S_n$, and then apply the formula: $S_n=(S_n+a)$ rem N, where a is a constant.

Thus for the natural solution for N=7 being 0,1,4,2,24,1 we can add, e.g. a=3 to each $S_n$ and transform the solution to 3,4,0,5,5,0,4.

Figure 3A:
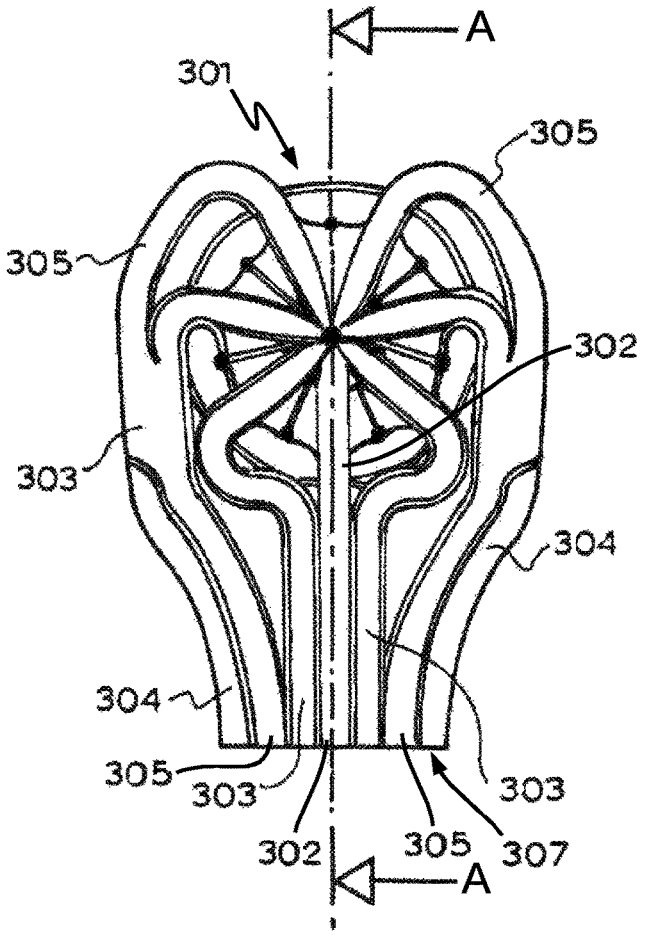
FIG. 3*a* shows a top plan view of the acoustical diffusion manifold of FIG. 1.
Figure 3B:
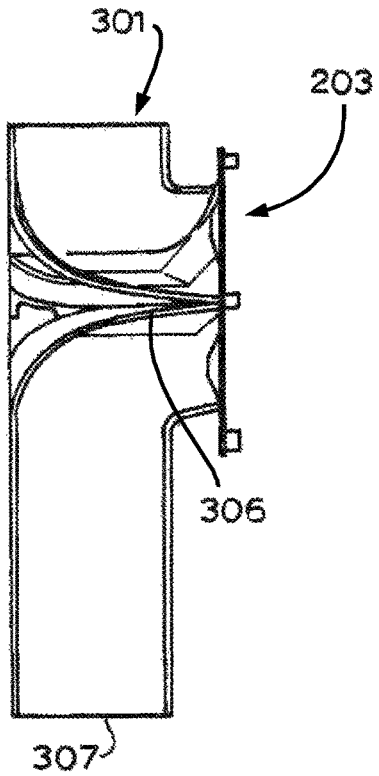
FIG. 3*b* is a cross-sectional view of the manifold as viewed along the line A-A in FIG. 3*a*.

FIG. 3 shows a plan and elevation view of the acoustical diffusion manifold described in FIG. 1.

FIG. 3 Section AA shown in detail shows element detail 306 wherein the acoustic energy is converted from the piston motion of a moving coil loudspeaker to a lateral motion along the length of the sector element.

Figure 4:
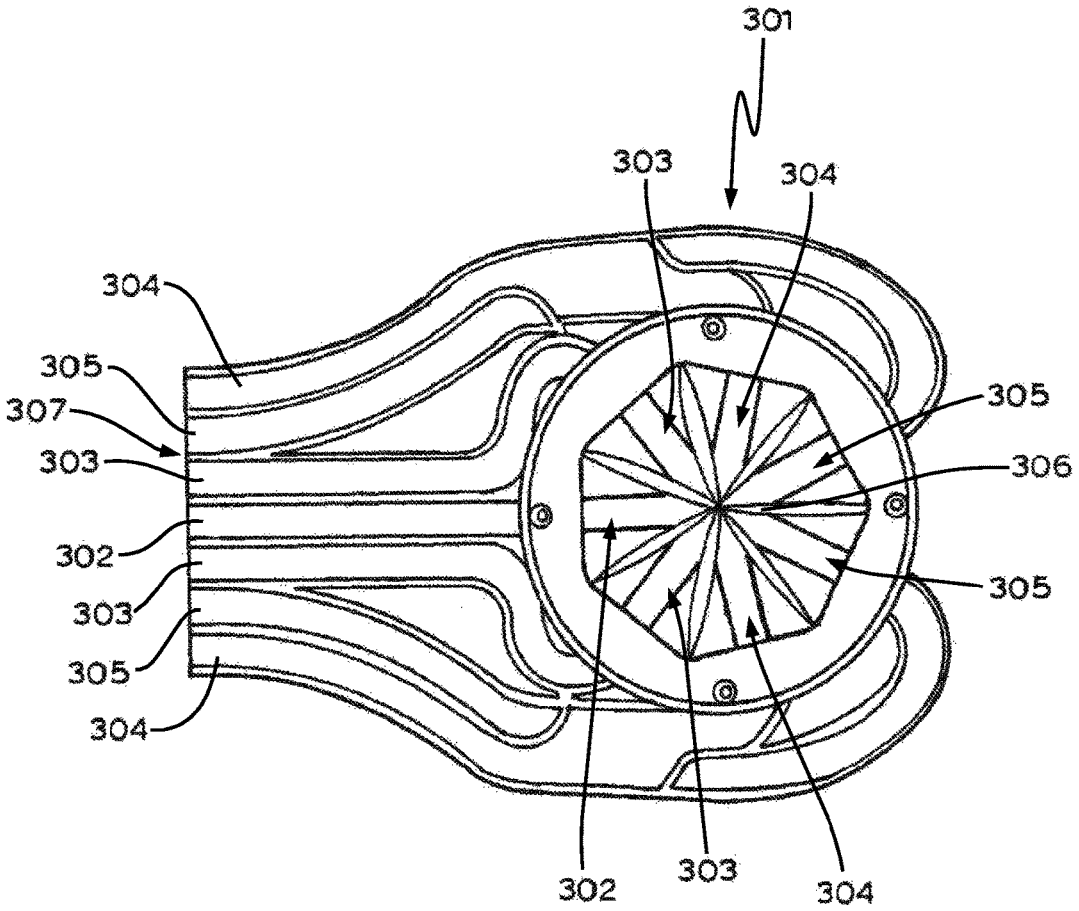
FIG. 4 is a bottom view of the acoustic diffusion manifold of FIG. 3, showing the manifold intake area that forms a hard on collider.

FIG. 4 is a bottom view of the concentric splitter intake area 401 of a hard on collider of the manifold described in FIGS. 1, 2, and 3.

In this view the detail of how the hard on collider portion, a circular area divided into 7 (N) equal sectors, segments the acoustic energy from a moving coil loudspeaker into 7 (N) equal area portions.

Each equal portion created by the hard on collider is then acoustically ducted 306 into the sector element pathway for individual guidance, through differing path lengths, and via the twister 303, to the outlet 307.

Some speaker drivers show a significant acceleration of the movement of the apparent acoustic centre at very high frequencies. The acoustic centre will start to move rapidly towards the voice coil of the driver as say above 10 kHz. The manifold design incorporating a concentric splitter arrangement to the hard on collider area 401 (FIG. 4). This arrangement eliminates errors due to movement in the acoustic centre as it is concentric to the loudspeaker driver and splits the acoustic driven wave arounds its centre into N identical portions. Thus any change in the acoustical centre position, as long as it is on a path concentric to the driver, will be symmetrically present in all N sectors.

Previous designs of the acoustic reflector embodiments by this inventor are prone to acoustic centre geometric movements and had to be accommodated for such movements.

The manifold 301 of FIG. 3*a* has a plurality of acoustical pathways (in other words, "channels" or "sectors") whose lengths difference are the solutions to the QRS multiplied by some unit length. The manifold 301 has seven sectors that include:

Sector 302, which has the shortest length of all seven sectors;

Two sectors 303 that have the same length as each other;

Two sectors 304 that have the same length as each other; and

Two sectors 305 that have the same length as each other, and have the longest lengths of all seven sectors.

The length of sector 302 is 0* unit length plus a constant, I; the lengths of sectors 303, which are immediately adjacent to sector 302, is 1* unit length plus the constant I; the lengths of sectors 304, which at the manifold outlet 307 are each at a lateral side of the array, is 2* unit length plus the constant I, etc. As the constant 'I' is present in the length of each sector, it does not form part of the length difference between channels. It is desired that the elements of acoustic energy radiated from the source 302 (FIG. 2), when they are radiate from the outlet 307 having the sectors 302, 303, 304, and 305 mix in a far field space to exhibit a diffuse and diffuse wave encoded sound field. The "perfect" solution to the QRS provides equal acoustic energy in all angular directions from the outlet 307 nominally within plus and minus PI/2 angular direction from the direction of radiation but in practice greater.

A preferred practical design of an acoustical diffusion manifold suitable for full range applications a channel outlet width is selected to be 8.15 mm. The overall reflector is therefore 57.05 mm.

The classic QRS solution for when the design frequency is selected to be 2600 Hz is shown in Table 4;

TABLE 4

| Sector reference number | QRS Element (n) | Solution to QRS | Length | Length doubling | Constant I | Modified Sector Length |
|---|---|---|---|---|---|---|
| 302 | 0 | 0 | 0 mm | 0 mm | 50 mm | 50 mm |
| 303 | 1 | 1 | 9.5 mm | 19 mm | 50 mm | 69 mm |
| 305 | 2 | 4 | 38.1 mm | 76.2 mm | 50 mm | 126.2 mm |
| 304 | 3 | 2 | 19.1 mm | 38.2 mm | 50 mm | 88.2 mm |
| 304 | 4 | 2 | 19.1 mm | 38.2 mm | 50 mm | 88.2 mm |
| 305 | 5 | 4 | 38.1 mm | 76.2 mm | 50 mm | 126.2 mm |
| 303 | 6 | 1 | 9.5 mm | 19 mm | 50 mm | 69 mm |

The datum from which the sector channel lengths are measured may be any suitable point on the hard on collider area provided these datums are identical in acoustic timing (phase) and amplitude.

Figure 5:
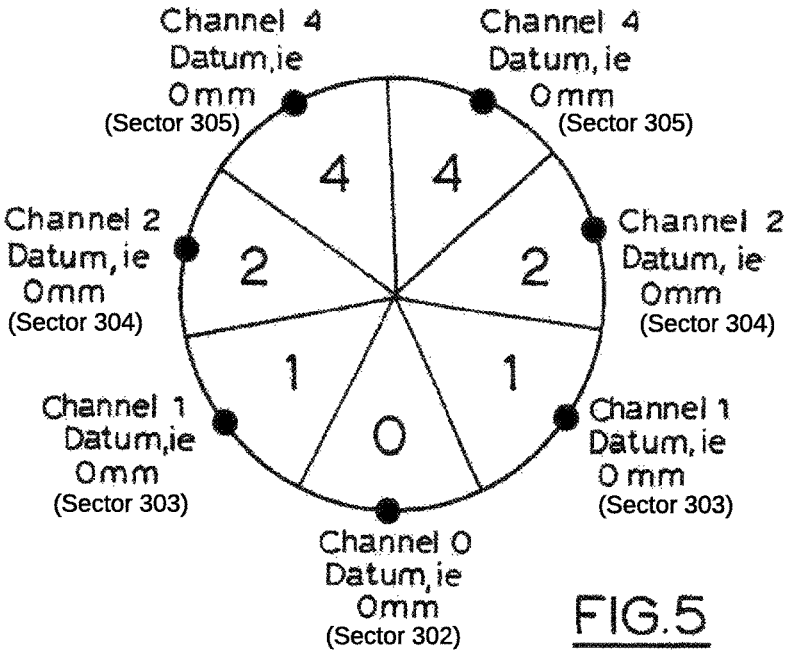
FIG. 5 is a schematic plan of the splitter of the manifold of FIG. 3, identifying datum points around the circumference of the splitter.

FIG. 5 shows the datum points defined as being on the perimeter of the concentric splitter cantered on each sector circumference. As this point is symmetrical to the sectors of the concentric splitter it can be assumed that the acoustic energy present at each point will be identical in time and therefore can be considered a zero datum to each relevant channel start point.

Figure 6:
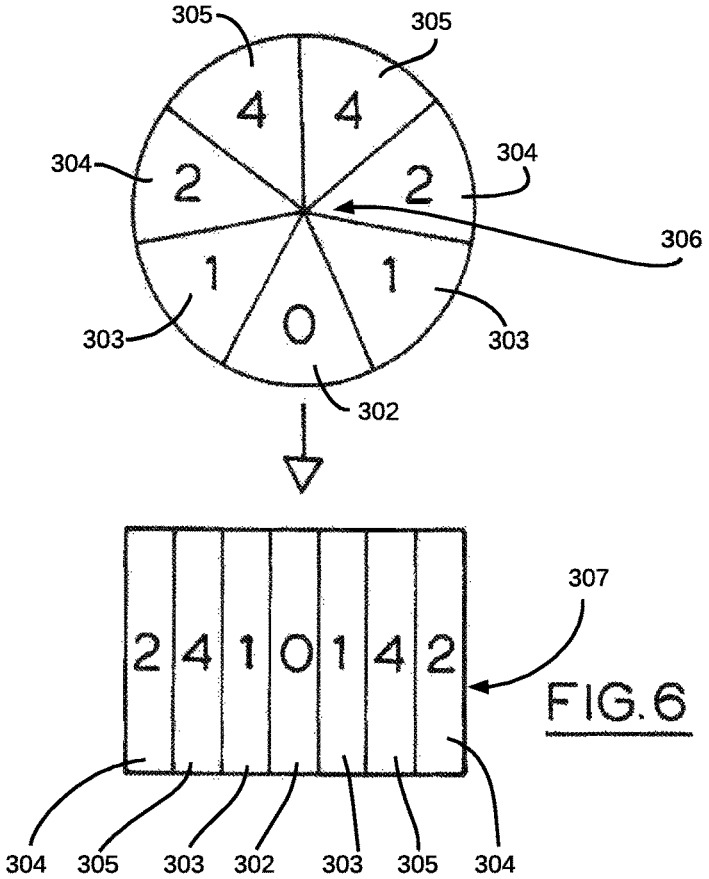
FIG. 6 is a schematic illustration of the manifold inlet and the manifold outlet of the manifold of FIG. 3.

FIG. 6 shows a representative drawing of both a concentric splitter of the the hard on collider portion of the manifold and the radiating outlet portion. As the outlet is positioned to one side of the hard on collider there is a natural distribution of sector portions that suit the QRD elemental sequence position on the outlet.

The closest sector portion is given the '0' element role and the path distance between it and the outlet is set to a minimum. Typically it would not be practical to set this distance to 0 mm. Therefore the resultant distance is considered a constant 'I' which is added to the length of all other element pathways so to add a set distance to all elements pathway. For example, using table 4 as a reference, the constant 'I' is set to be 50 mm. In practice this length 'I' could be meters in length. Such longer constant lengths would allow for the driver to be located somewhat remotely form the outlet. in such a way the drivers could be in the base of a flat screen TV whilst the radiating outlets where located at the edges of the screen. Similarly a car could ave the driver embedded centrally in the dash whilst the outlet was on the surface of the dash.

The hard on collider element adjacent to the '0' sector are assigned the '1' element pathway. The length of this pathway, using table 4 as a reference, is 69 mm being compromised of the constant 'I' of 50 mm and the '1' element solution of 19 mm.

The path taken by the '1' element is arranged such that it overall passage to the outlet translates to 69 mm in path length. Typically the centre line of the sector channel pathway is considered the reference for measuring length. Any resultant errors, due to whatever acoustical phenomena, can be corrected through micro adjustments to the element pathway passage to in effect increase or decrease the elemental length to compensate these errors.

The sectors immediately adjacent to the '1' element are assigned the '2' element pathway length. Using table 4 as a reference the 2' element pathway length is 88.2 mm comprised of the constant 'I' of 50 mm and the '2' element path length of 38.2 mm.

The path taken by the 2' element is arranged such that it overall passage to the outlet translates to 88.2 mm in path length.

The sectors immediately adjacent to the the '2' element are assigned the '4' element pathway length. These two sectors also are adjacent to each other completing the seven sector elements of the hard on collider. Using table 4 as a reference the '4' element pathway length is 126.2 mm comprised of the constant 'I' of 50 mm and the '4' element path length of 76.2 mm.

The path taken by the '4' element is arranged such that it overall passage to the outlet translates to 126.2 mm in path length. However the '2' elements and the '4' element have to traverse past each other to end up in the correct sequence in the outlet manifold.

Figure 7:
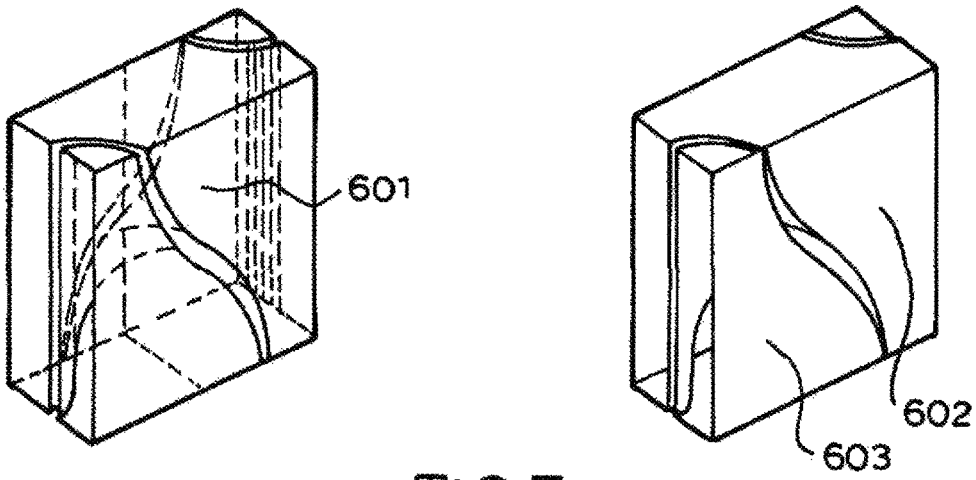
FIG. 7 shows an detailed isometric view of the 'twister' component.

FIG. 7 shows an detailed isometric view of the 'twister' component of the portion of sector elements '2' and '4' wherein they change position such that the outside element of path length determined by '4' 602 exchanges position with the inside element of path length determined by '2' 603 via the constant cross sectional area transform portion 601. In this view the element 602 on the outside of the sector element formation is manipulated by twister such that element end up being transformed to the inside location by the time it reaches the outlet.

Figure 8:
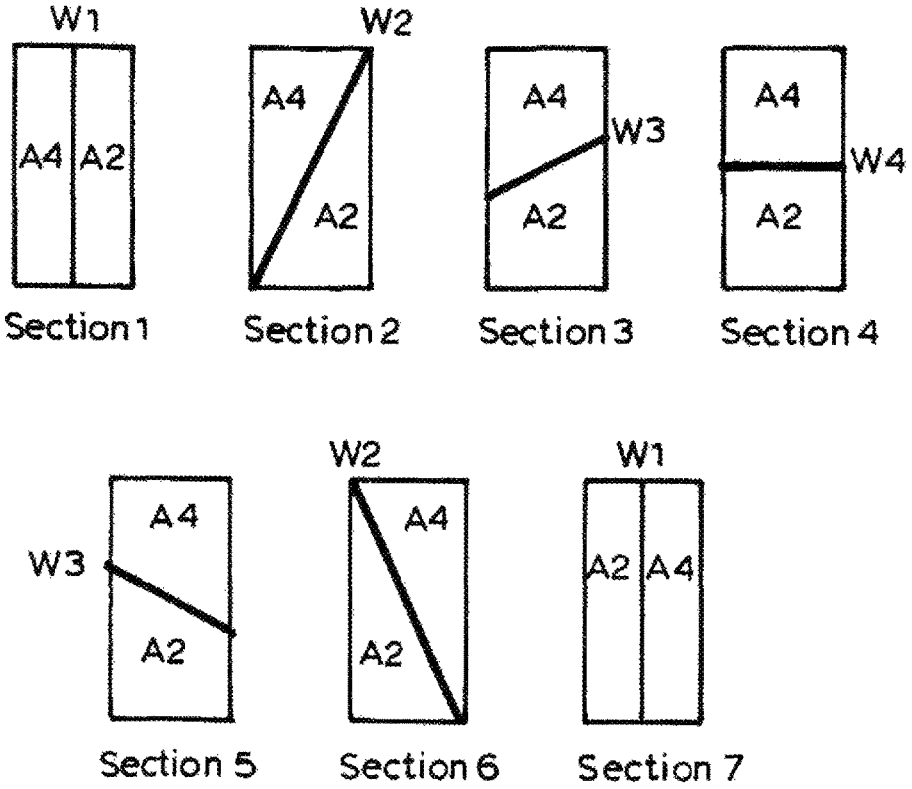
FIG. 8 shows sectional slices of portions of the twister element.

FIG. 8 shows seven sections through a twister portion including the start and end points. At the start the separating fin is vertical and the area of the '4' element (A4) is equal to the area of the '2' element (A2). At the next section the central separating fin has started to rotate about its central point. As its length is longer than the initial separator its width will be slightly less. In such a way the exact cross sectional area of A4 and A2 can be maintained.

In the next section the separator fin has traversed past the vertical limits and hots the side walls. Its length is shorter thus its width is wider such that the cross sectional areas A4 and A2 are maintained. This process continues for the remaining sections. This a constant cross sectional area is maintained for the channels and the channel 2 as the acoustical energy transverses the twister portion.

Two main design variables, the unit depth and the element width govern the useful frequency bandwidth over which the acoustical diffusion manifold is effective. The lowest useful frequency is controlled by the amount of path introduced by the various well depths. The highest useful frequency is controlled by the width of the wells. For frequencies higher than that of which the related wavelength is equivalent to 2×the channel width the acoustic energy will not travel on a direct path along the length of the channels. It will travel on diagonal paths along the length of the channels and thus the effective length will be greater than the physical lengths. This will cause the diffusion process to move out of tolerance.

To control the low frequency design frequency of the mechanical diffuse wave generator, the unit length is set to equal 1/N times the design wavelength. For example, if the unit length is 19 millimeters and N=7, then the design wavelength is given by:

X=N×19 millimeters=133 millimeter

From this, the design frequency is calculated:

$$F = c/\lambda_D$$
$$= 343/(133\times10^{-3})$$
$$= 2.6\ \text{kHz}$$

Below the design frequency the wells become dimensionally insignificant to the phase of the source frequency and the acoustical arrangement acts as a normal radiator or flat surface reflector. The highest frequency at which the reflector is, effective, the cut-off frequency, is governed by the individual well width, w, or the relation to the design frequency. Using the previous example, if the well width is 9.5 millimeters then the cut-off frequency is given by;

$$\lambda = w\times2$$
$$= 19\ \text{millimeters}$$

And thus the frequency is given by:

$$F = c/\lambda_W$$
$$= 343/(19\times10^{-3})$$
$$= 18.05\ \text{kHz}$$

Another factor that limits the high frequency effectiveness is that the sequence does not work at a frequency of (N−1) times the design frequency. That is, still using the numbers of the previous example, $$\lambda_{high} = \lambda_D/(N-1)$$
$$\lambda_D = 133\ \text{mm}$$
$$\text{thus } \lambda_{high} = 133\ \text{mm}/6$$
$$= 22.2\ \text{mm}$$

-continued $$\text{thus } f_{high} = 343/\lambda_D$$
$$= 343/22.2 \text{ mm}$$
$$= 15.5 \text{ kHz}$$

In this example, cut-off frequency governed by the design frequency is less the lesser of the two limiting frequencies and is thus the actual high frequency cut off point. Therefore, the lower of the two frequencies will be the cut-off frequency. i.e. 15.5 kHz.

To ensure against error interference with the zero autocorrelation property of the diffuse wave function great care and correct compensations have to be incorporated into the design. At zero autocorrelation the output by itself will carry no meaningful information that can be interpreted by an observant receptor such as that of the human listening system. The resultant diffuse wave function is 'silent'. However, the tolerance to errors is very small whereby the percentage error from ideal should be less than 3% in amplitude or phase. The greater the error the more audible the diffuse wave function becomes. It is the intensity of the driving source signal we want to hear in the listening spatial environment, not the diffuse wave function. Because the QRS effects a wide range of frequencies nominally it is most important that the higher end of the useful spectrum of the design maintain a criteria of less than 3% error. As the frequency spectrum lowers, the component wavelength increases and the errors due to path travel will become relatively insignificant provided the source spatial origin remains stationary over the spectral domain.

In a preferred embodiment the cross sectional area of the hard on collider is the same as the total outlet area. Effort is taken to ensure the cross-sectional area of the individual acoustic ducts is constant from the source to the outlet.

Figure 9:
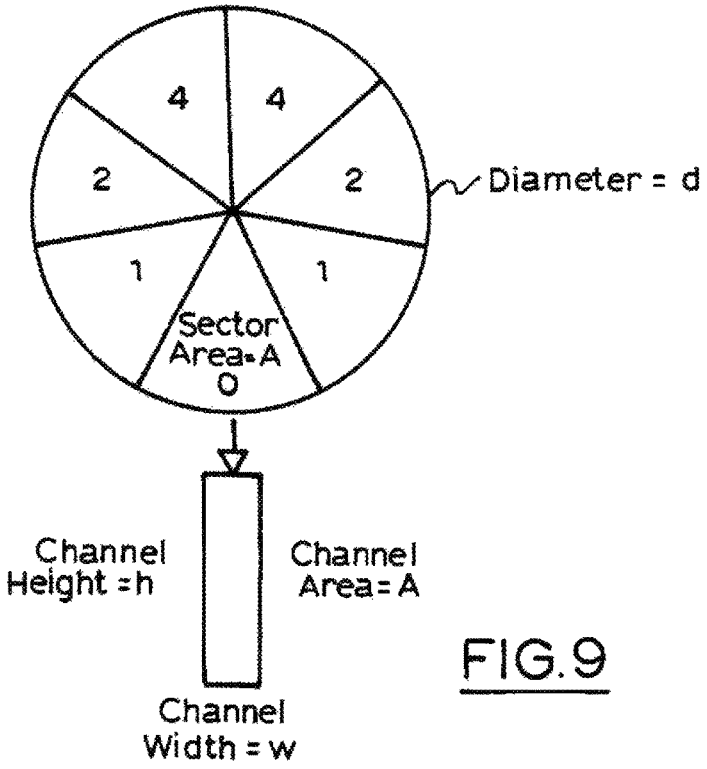
FIG. 9 shows an uncompressed channel design.

FIG. 9 shows an uncompressed cross sectional area configuration whereby the area of the concentric splitter sector is the same as the channels path cross sectional area.

EG—If the concentric splitter diameter is 50 mm them the area of the concentric splitter is given by;

$$\text{Area}_{CS} = Pl \times 25 \text{ mm}^2$$
$$= 1963 \text{ mm}^2$$

The area of one sector is;

$$\text{Area}_{Sector} = 1963 \text{ mm}^2/7$$
$$= 280 \text{ mm}^2$$

If the width of the channel is 9.5 mm then the height of the channel is given by;

$$\text{Height} = \text{Area}_{Sector}/\text{Width}$$
$$= 280/9.5$$
$$= 29.5 \text{ mm}$$

In another embodiment the portion of the acoustical diffusion manifold that forms the hard on collider (305 or FIG. 3) is used to compress the cross-sectional area of the sector outlet of the hard on collider take off portion to a scale of the original take off area and therefore amplifying the volume velocity of the acoustic waves within the acoustical ducts. This will increase the sound pressure level inside the ducts. Care should be taken to ensure the acoustical wave does not introduce unwanted distortions using this compression of area technique.

Figure 10:
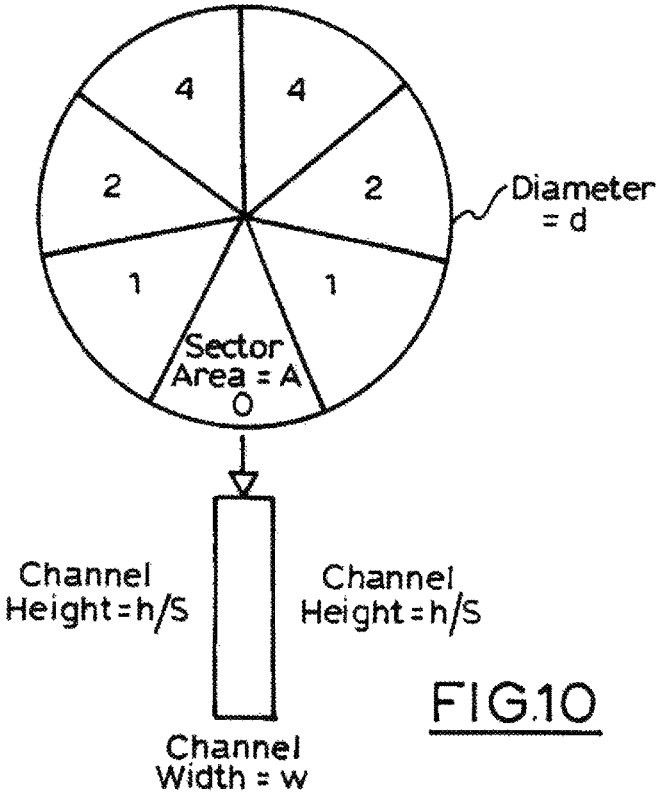
FIG. 10 shows a compressed channel design.

FIG. 10 shows an compressed cross sectional area configuration whereby the area of the concentric splitter sector is larger than the channels path cross sectional area.

EG—If the concentric splitter diameter is 50 mm them the area of the concentric splitter is given by;

$$\text{Area}_{CS} = Pl \times 25 \text{ mm}^2$$
$$= 1963 \text{ mm}^2$$

The area of one sector is;

$$\text{Area}_{Sector} = 1963 \text{ mm}^2/7$$
$$= 280 \text{ mm}^2$$

If the width of the channel is 9.5 mm then the height of the channel is given by;

$$\text{Height} = \text{Area}_{Sector}/(\text{Width} \times \text{Scale})$$
$$= 280/(9.5 \times 2)$$
$$= 14.8 \text{ mm}$$

By introducing a scale factor of 2 we have halved the height of the outlet.

As a consequence we can expect the volume velocity of the acoustic energy inside the channels to be twice that of the previous uncompressed arrangement.

The benefit of such an approach is that the size of the outlet manifold can be reduced and therefore compacting the resultant design.

FIGS. 11 to 16 illustrate a minituarised manifold suitable for use in a cell phone of the smart phone type.

Figure 11:
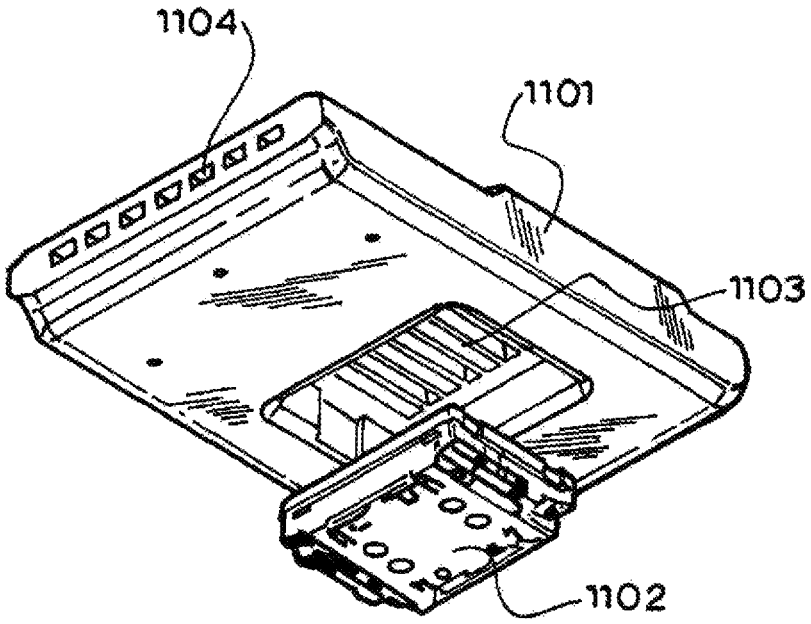
FIG. 11 is an isometric view of a miniature acoustical diffusion manifold.

FIG. 11 is an isometric view of a miniature acoustical diffusion manifold 1101 designed to accommodate a Cobra smartphone loudspeaker 1102 via the recess 1103 wherein it is divided into 7 equal portions by a hard on collider and guided by length variable pathways determined by the QRD towards the outlet array 1104.

The loudspeaker driver is considered to behave as a perfect piston over its applications range of frequencies. If this is not the case then a concentric splitter hard on collider take off arrangement could be used.

If it does not suit to have the loudspeaker driver coupled directly to the hard on collider area then a small cavity of air can be used to compliantly couple these elements. The compliance space effect of absorbing low frequencies are arranged to occur below the effective radiation active portion of the smartphone loudspeaker driver. For a Cobra loudspeaker the active region of radiation is usually 500 Hz and above. Thus the compliant cavity should become an acoustical short circuit at 500 Hz and above.

FIG. 8 shows an isometric view of the skeleton of the miniature acoustical diffusion manifold 701 without is casing. The various pathways for the 7 (N) elements via which they find their way to the outlet 704 are displayed. The objective is to compact the design as much as possible without loosing the desired acoustical effects provided by convolving an audio signal with a QRD.

TABLE 5

| Element | Solution to QRD | Length | Length doubling | Constant I | Modified Length |
|---|---|---|---|---|---|
| 0 | 0 | 0 mm | 0 mm | 16 mm | 16 mm |
| 1 | 1 | 9.5 mm | 15.5 mm | 16 mm | 31.5 mm |
| 2 | 4 | 38.1 mm | 62 mm | 16 mm | 78 mm |
| 3 | 2 | 19.1 mm | 31 mm | 16 mm | 47 mm |
| 4 | 2 | 19.1 mm | 31 mm | 16 mm | 47 mm |
| 5 | 4 | 38.1 mm | 62 mm | 16 mm | 78 mm |
| 6 | 1 | 9.5 mm | 15.5 mm | 16 mm | 31.5 mm |

To control the low frequency design frequency of the miniature acoustical diffusion manifold, the unit length is set to equal 1/N times the design wavelength. For example, if the unit length is 15.5 millimeters and N=7, then the design wavelength is given by:

X=N×15.5 millimeters=108.6 millimeter

From this, the design frequency is calculated:

$$F = c/\lambda_D$$
$$= 343/(108.6\times10^{-3})$$
$$= 3.16 \text{ kHz}$$

Below the design frequency the wells become dimensionally insignificant to the phase of the source frequency and the acoustical arrangement acts as a normal radiator or flat surface driver. The highest frequency at which the reflector is effective, the cut-off frequency, is governed by the individual well width, w, or the relation to the design frequency. Using the previous example, if the well width is 3.0 millimeters then the cut-off frequency is given by;

$$\lambda = w\times2$$
$$= 6.0 \text{ millimeters}$$

And thus the frequency is given by:

$$F = c/\lambda_W$$
$$= 343/(6.0\times10^{-3})$$
$$= 57.2 \text{ kHz}$$

Another factor that limits the high frequency effectiveness is that the sequence does not work at a frequency of (N−1) times the design frequency. That is, still using the numbers of the previous example, $$\lambda_{high} = \lambda_D/(N-1)$$
$$\lambda_D = 108.6 \text{ mm}$$
$$\text{thus } \lambda_{high} = 108.6 \text{ mm}/6$$
$$= 18.0 \text{ mm}$$
$$\text{thus } f_{high} = 343/\lambda_D$$
$$= 343/18.0 \text{ mm}$$
$$= 19 \text{ kHz}$$

In this example, cut-off frequency governed by design frequency is less the lesser of the two limiting frequencies and is thus the actual high frequency cut off point. Therefore, the lower of the two frequencies will be the cut-off frequency. i.e. 19 kHz.

Figure 12:
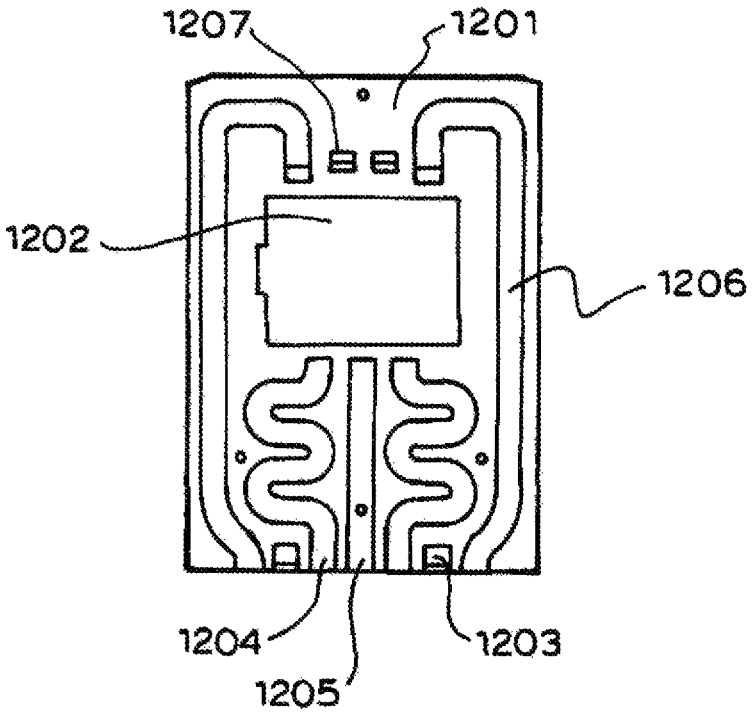
FIG. 12 shows an isometric view of the skeleton of the miniature acoustical diffusion manifold.
Figure 13:
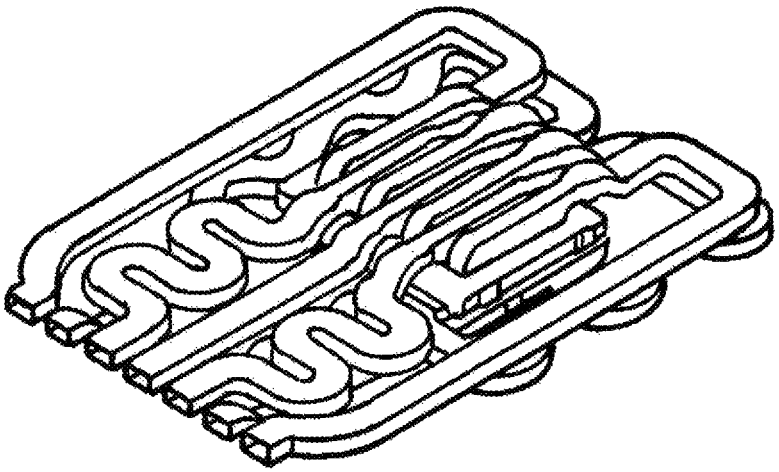
FIG. 13 shows the top layer of sector element pathways for the miniature acoustic manifold.
Figure 14:
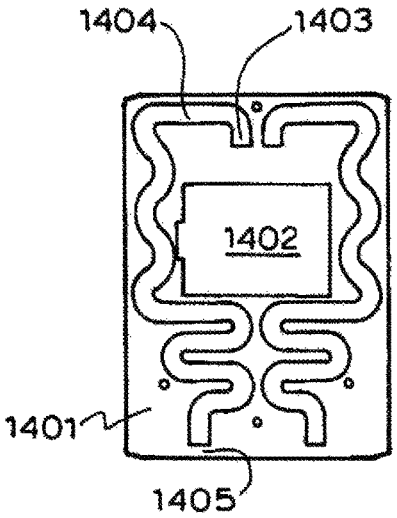
FIG. 14 shows the lower layer of the miniature acoustical diffusion manifold shown in FIG. 13.

FIG. 12 shows the top layer of sector element pathways for the miniature smartphone acoustical diffusion manifold. In this layer 1201 is a rebate 1202 adequate, suitable, and effective to accommodate a Cobra smartphone loudspeaker.

Using table 5 as a reference the centre element 1205 is given the path length 16 mm.

Adjacent to the centre element 1205 but on the opposite side are the intakes to element '4' 1207. These element are diverted to the lower layer via ducts 1207 and reappear adjacent the array outlet at locations 1203. These '4' pathways are manipulated in length such that they are 78 mm long.

On the same side as the centre '0' element 1205 but to either side is the '1' element 1204 that is 31.5 mm long in pathway length.

Figure 15:
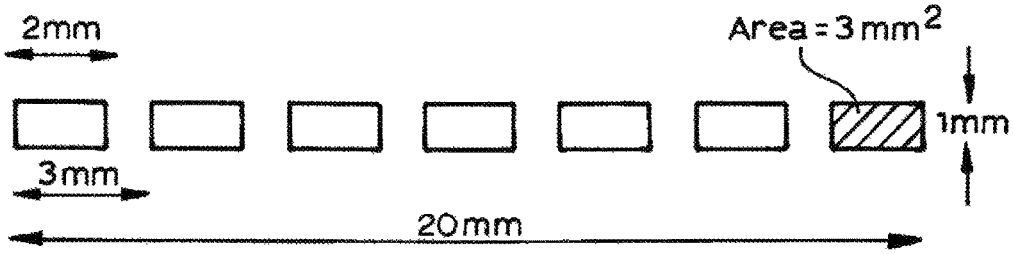
FIG. 15 shows the outlet dimensions of a cobra manifold.

FIG. 10 shows the lower layer 1301 of the miniature acoustic manifold. This layer also is adequate, effective, and suitable to accommodate a Cobra smartphone loudspeaker via a recess 1302 that is the same location that of the upper layer 901. The upper layer 1201 feeds via the duct 1207 and 1303 acoustic energy into the pathway 1304 towards the outlet and ducts it up to the outlet layer via ducts 1305. FIG. 15 shows the outlet dimensions of a typical smart phone manifold design. The channel outlet is 2 mm wide and 1 mm high. The cross sectional area is therefore 2 $mm^2$. There are seven channels spaced 3 mm apart. This makes the output array 20 mm wide and 1 mm high. The total area of the outlet is 7×2 $mm^2$=14 $mm^2$.

Figure 16:
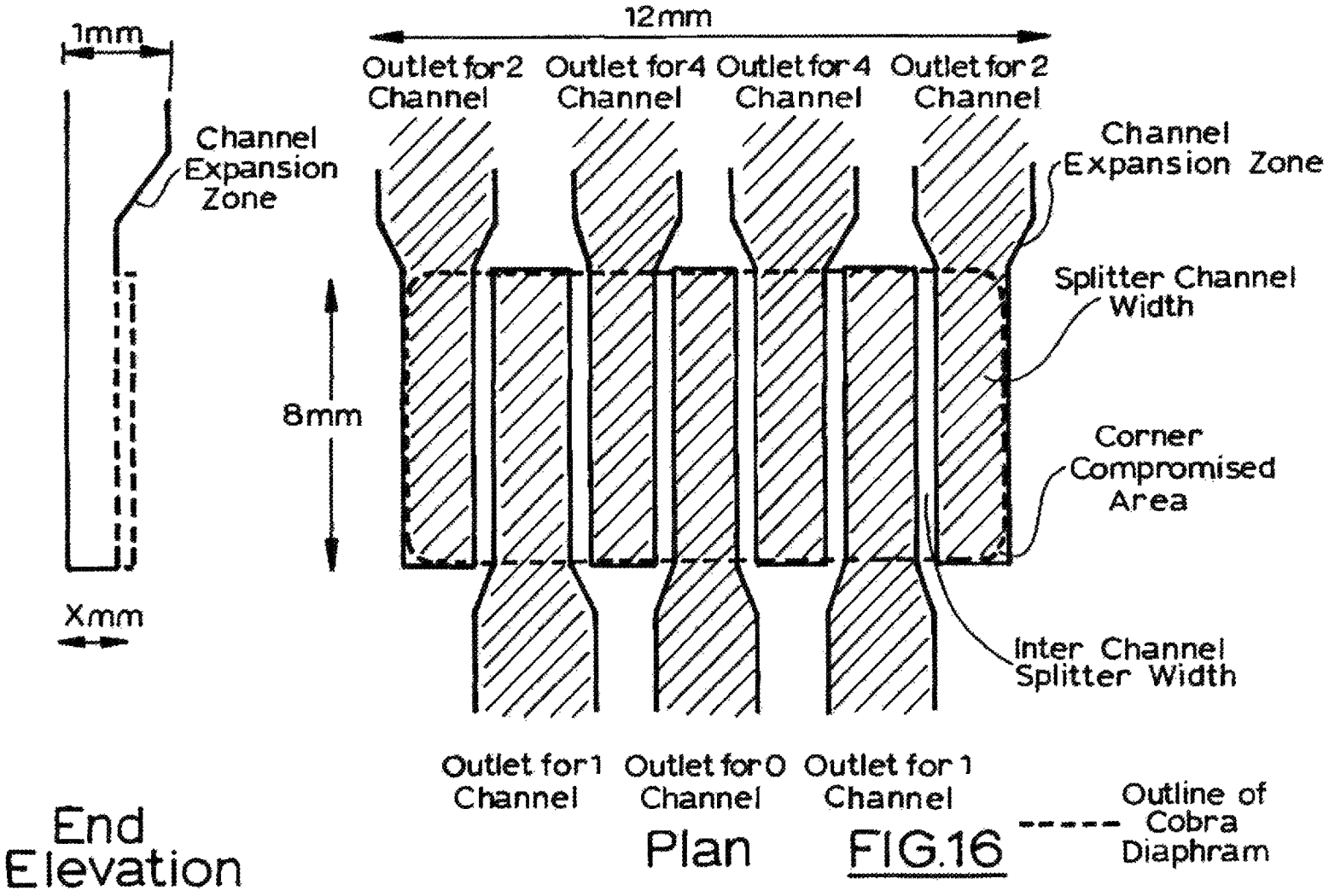
FIG. 16 shows the hard on collider take off area details for a Cobra manifold.

FIG. 16 shows the take-off area of the cobra diaphragm.

As the diaphragm of the cobra has radiuses corners care has to be taken to compensate for this in the '2' element take off areas. As the area above the diaphragm is so small it is not possible to have normal sized channels areas in the take off hard on collider area. Thus a compression scale is used.

Figure 17:
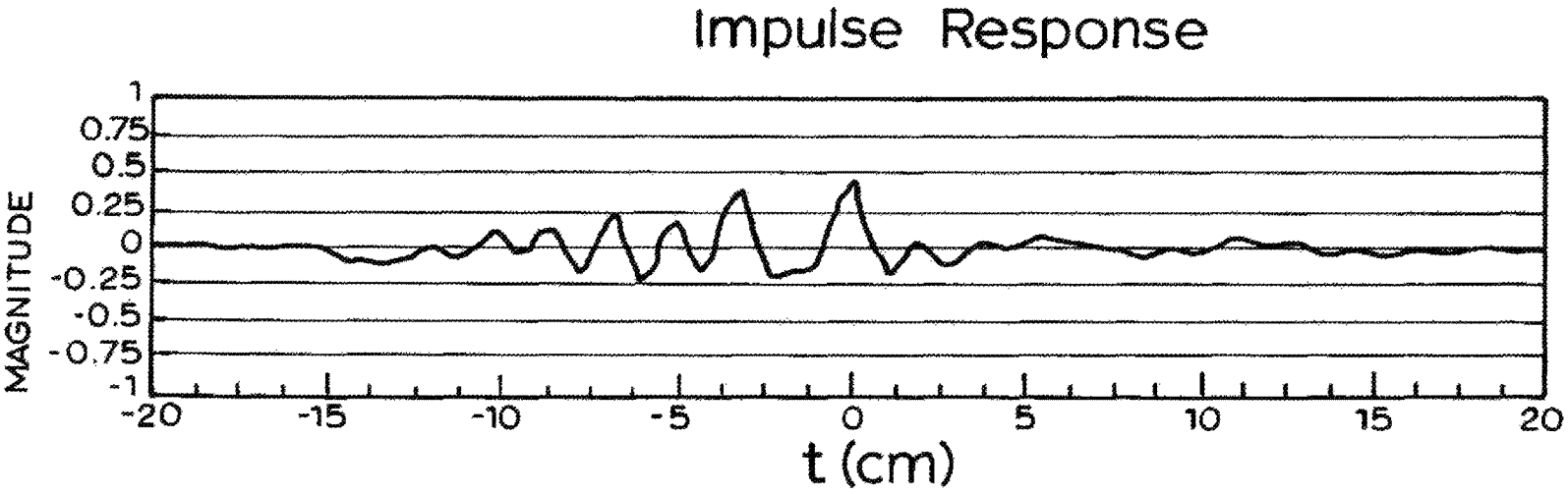
FIG. 17 shows the close up detail of the captured impulse response of a loudspeaker of this invention.

The diaphragm is 12 mm long and 8 mm high. Thus it has a cross sectional area of 12×8=96 $mm^2$ As the outlet is 14 $mm^2$ a scale of 96/14=6.9 compression factor is implicit in this design. Thus the volume velocities are 6.9 times higher in the channels than at the diaphragm. One needs to be careful not to enter into non linear acoustic sound pressure levels within the channels when implementing these high scale factors. FIG. 17 shows the close up detail of the captured impulse response of a loudspeaker of this invention. This is the window of sound from −20 cm prior to the maximum recorded value to 20 cm after the maximum recorded value. The central section around t=0 cm is shaped like that of a Gabor wavelet. But there is a lot of the signal present in the measurement before and after the Gabor wavelet looking middle portion. This may be the 'ringing' from a poorly damped spectral enclosure.

Figure 18:
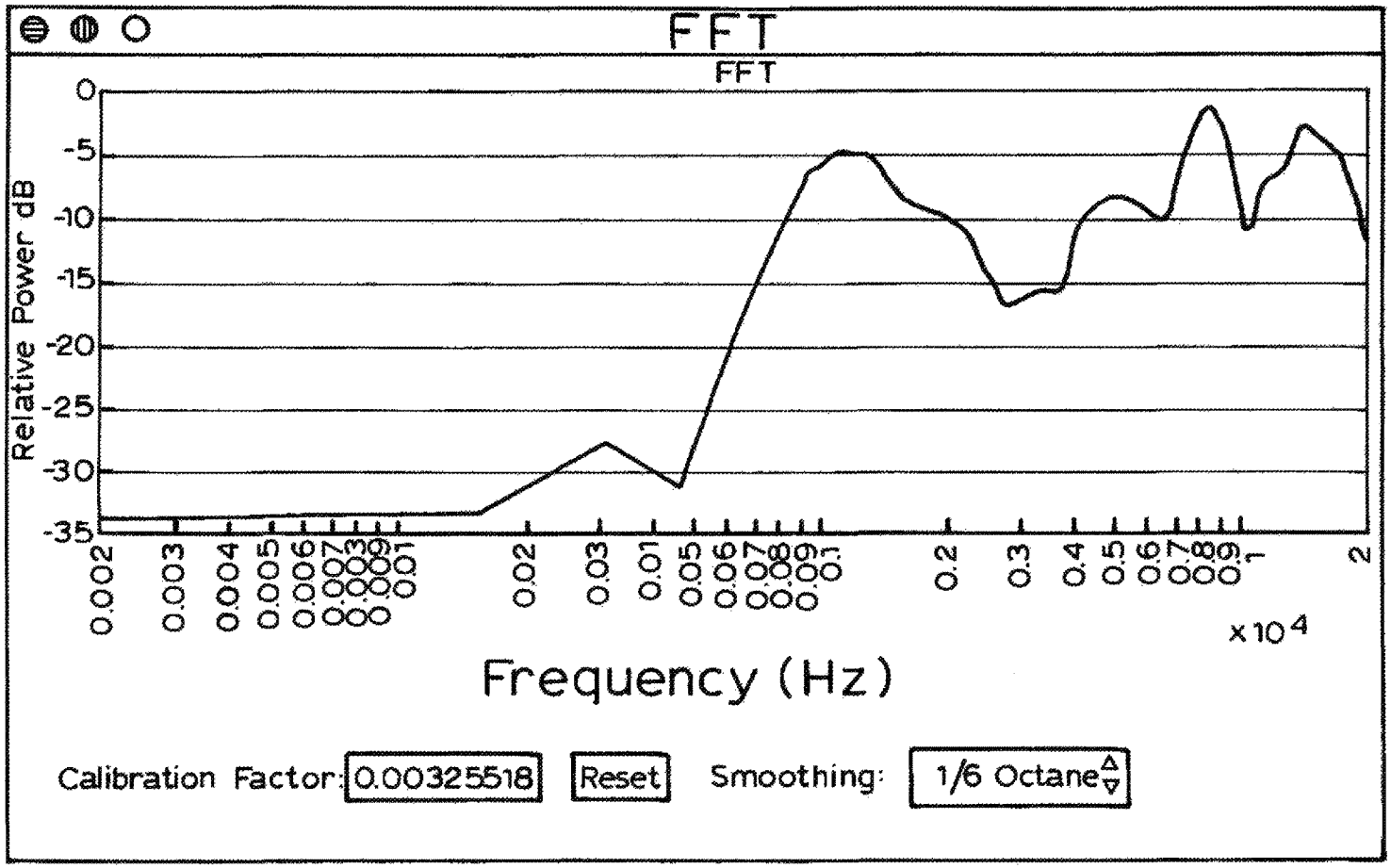
FIG. 18 shows the Fast Fourier Transform FFT of a manifold of this invention.

FIG. 18 shows the Fast Fourier Transform FFT of a manifold of this invention developed for a Cobra manifold. This embodiment is suitable for use on small consumer electronics devices such as smart phones. So it has the ability to temporally mark (wavelet encode) into the listening space the sudden phase changes in the audio signal. The prior art criteria of FFT show little distortion through the addition of this wavelet encoding manifold. This spectral curve can be equalised by the host smart phone electronics.

There is little spectral bass below 500 z in this device. It is plausible to convert bass sounds into their equivalent sudden phase jumps on a carrier frequency above 500 Hz such that these bass sounds become perceptible via the temporal information channel to the brain rather than the spectral information channel to the brain that will require FFT energy below 500 Hz. Spectral energy below 500 Hz is simply not supported by the physics of these small speaker drivers.

A benefit of the increased sound pressure levels due to increased volume velocities is an increased radiated sound pressure level into the listening space.

Figure 19:
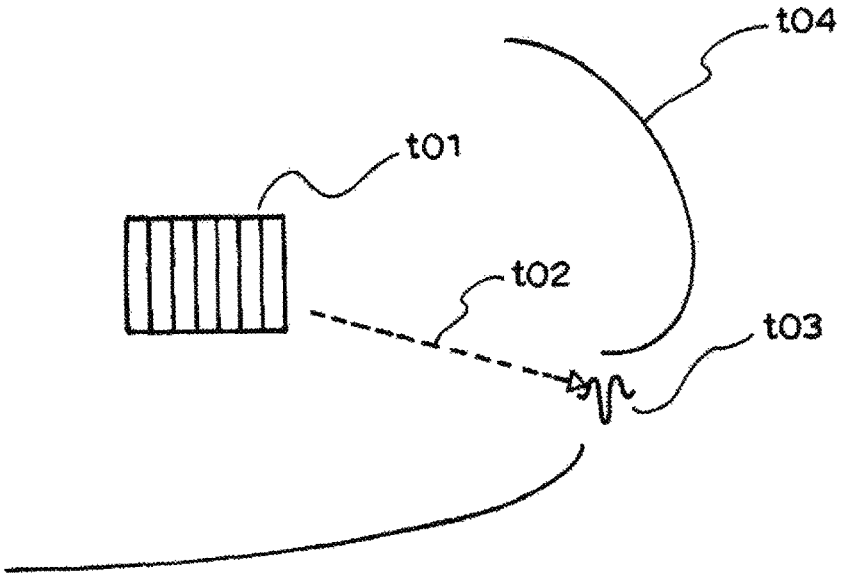
FIG. 19 shows an isometric view of a manifold loudspeaker with a wavelet transient ring radiation.

FIG. 19 shows a manifold loudspeaker t01 radiating a sound field in which there is a phase anomaly (temporal activity) at a radius t02. The transient of this phase nominally is a wavelet t03 and this wavelet exists of a circular ring 104 at radius t02 around the manifold loudspeaker t01.

Figure 20:
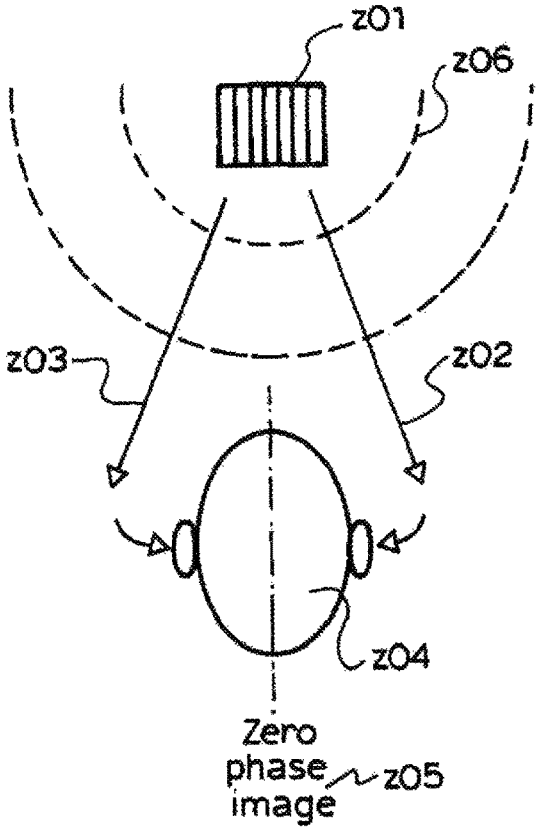
FIG. 20 shows a listener in relation to a single manifold loudspeaker that radiates wavelet rings.

FIG. 20 shows the same manifold loudspeaker z01 radiating two phase anomalies causing two temporal wavelet rings z06. A human standing in this radiated field will hear these temporal rings z06 via both ears z03 and z02 such to cause a zero phase image z05 inside ones perception system.

Figure 21:
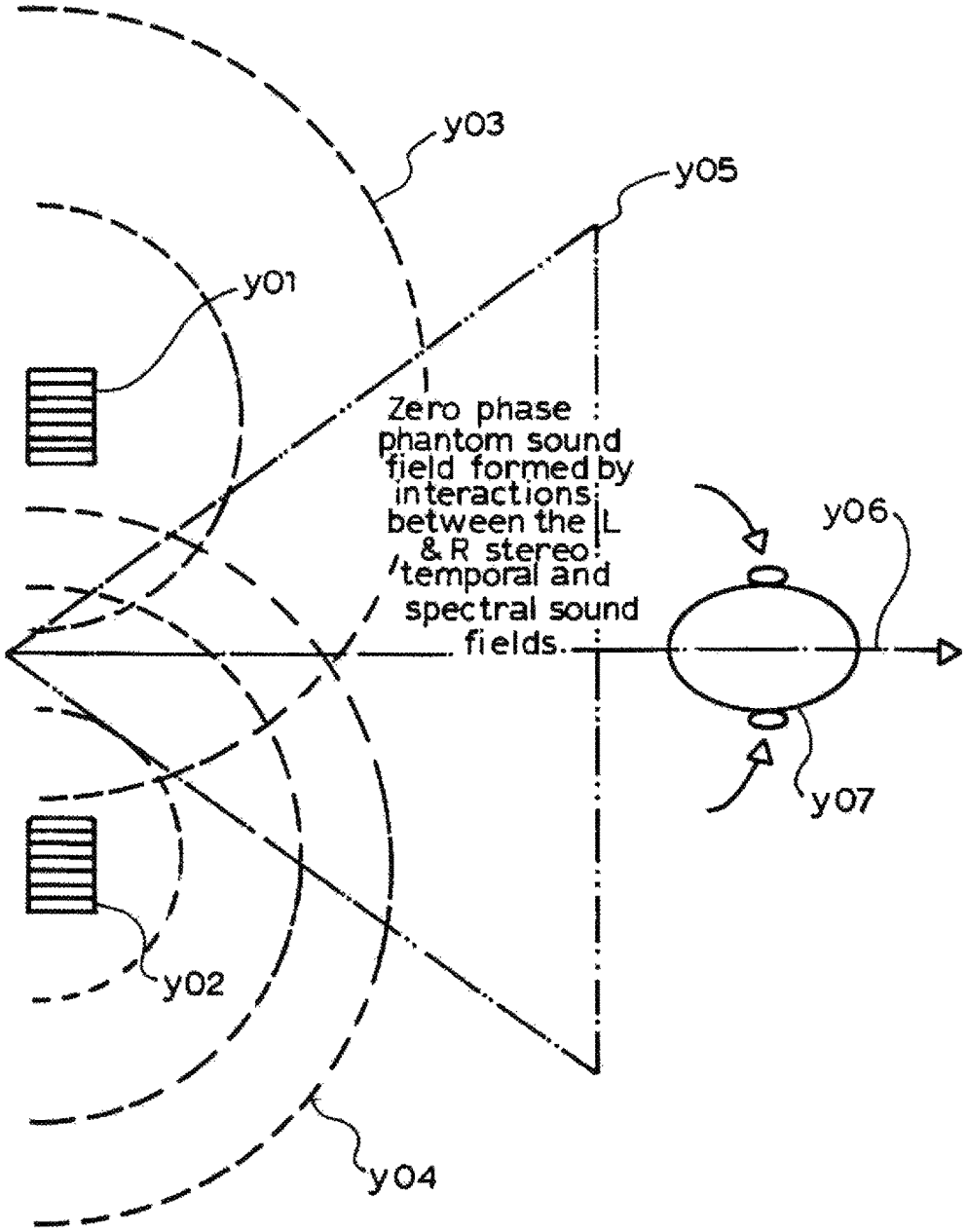
FIG. 21 shows a stereo air of manifold loudspeakers that radiate individually different wavelet ring patterns.

FIG. 21 shows a stereo air of manifold loudspeakers y01 and y02 that radiate temporal rings y03 and y04 based on each channels phase anomalies. Monaural information in the stereo mix will manifest as coherent acoustic energy along the centre line of these speakers y06. A listener y07 will hear both direct energy form manifold speakers y01 and y02. They will also experience a zero phase phantom sound field formed by interactions between he left and right stereo signals causing both a spectral and temporal sound field. Phase congruency will exists in this zero phase sound field. Minute difference between left and right channels will build a virtual reality acoustic within the zero phase sound field.

Figure 22:
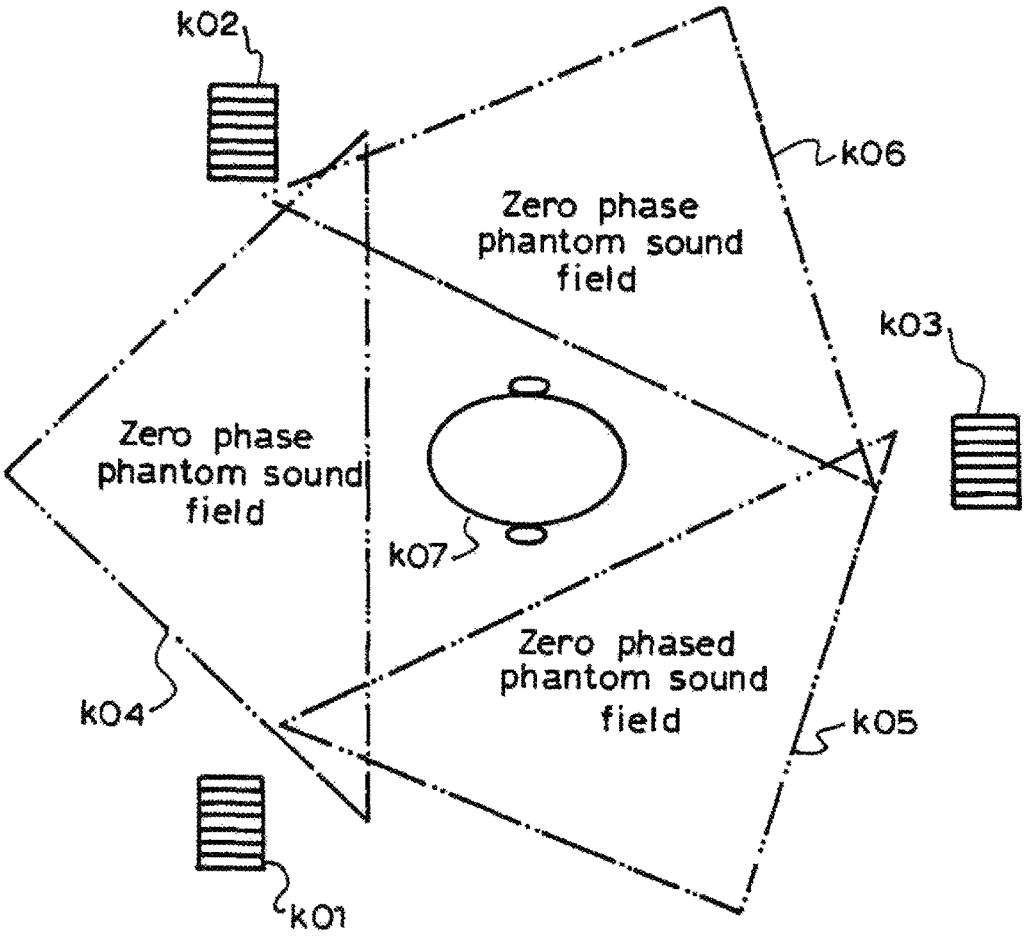
FIG. 22 shows a complete surround sound system using three manifold speakers.

This image will exhibit depth of field as well as specular imaging between channels. FIG. 22 shows three manifold loudspeakers k01, k02, and k03 placed around a listener k07. These three manifold loudspeakers 101 k02 and k03 will create three direct sound field form this monaural content and three phantom zero phase sound fields form the interactive sound fields. This will provide a laterally immersive listening space.

Figure 23:
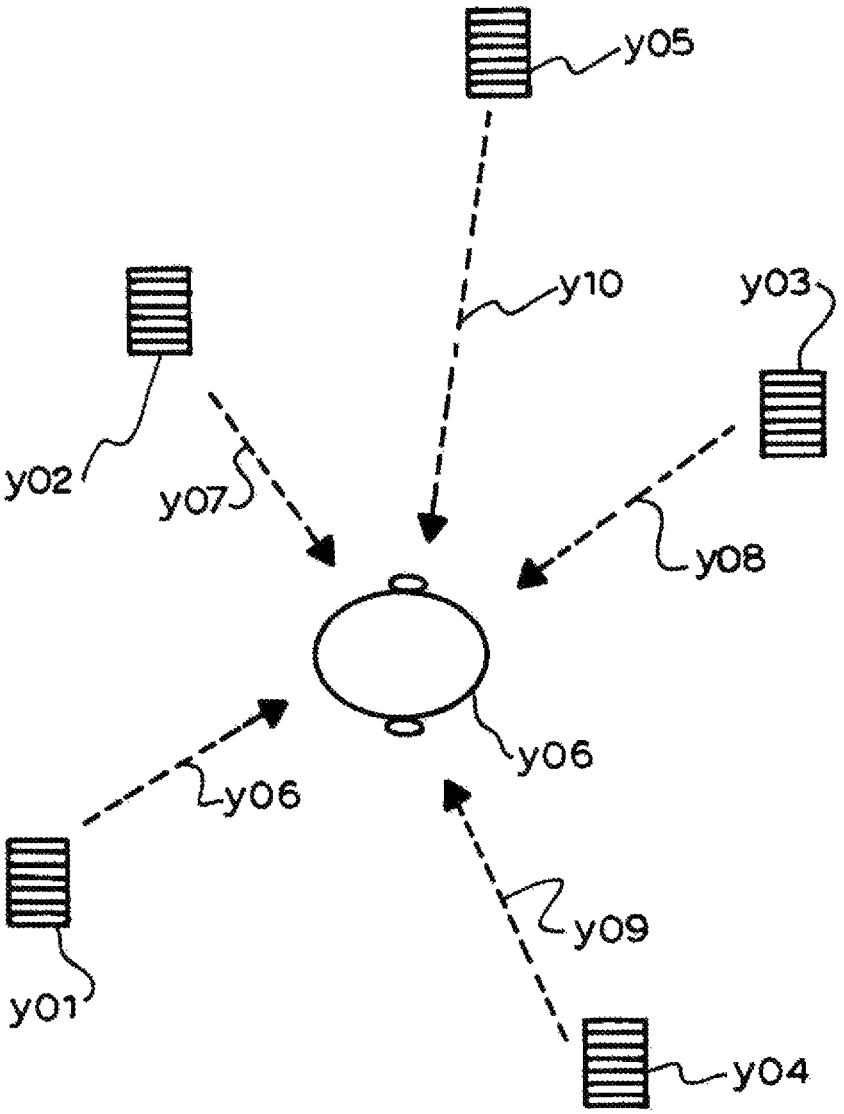
FIG. 23 shows an extended virtual reality environment in which five manifold loudspeakers are used.

FIG. 23 shows a complete virtual reality sound space created with five manifold loudspeaker y01 y02 y03 y04 and y05. Manifold speakers y01 y02 y03 and y04 are in a quadraphonic arrange placed laterally around the listener y06. Manifold speaker y05 is places above the listener y06. these manifold loudspeakers y01 y02 y03 y04 and y05 will create five direct zero phase monaural perceptions form monaural content form each source. They will create 6 lateral stereo zero phase sound fields form the interactions of lateral sound sources. i.e.;

| | |
|---|---|
| y01 and y02 | y02 and y03 |
| y03 and y04 | y04 and y01 |
| y01 and y03 | y02 and y04 |

and they will create four overhead zero phase sound fields from the stereo interaction between;

| | |
|---|---|
| y01 and y05 | y02 and y05 |
| y03 and y05 | y04 and y05 |

This will provide an immersive reality acoustic through the recording and manipulation of a 5 channel audio signal. Encoding 5 channels of audio in a digital file is known in the art. A zero phase zone such as described is a simulation of a 'live' acoustic sound field.

Figure 24:
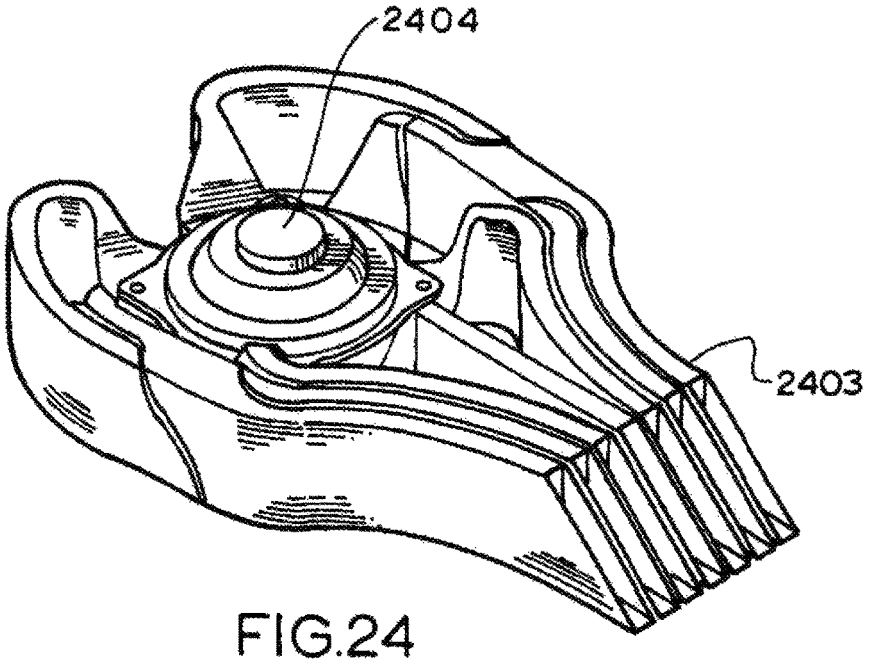
FIG. 24—is an isometric of a manifold speaker driver arrangement.

6 lateral stereo zero phase soundfields 4 vertical zero phase soundfields 5 direct mono zero phase soundfields FIG. 24 shows manifold 2403 with the speaker driver 2404 mounted hard against its hard on collider. The profile of the dual arrangement is that both parts nest inside each other. The outlet is shaped as to suit the arrangement into the dash of a car.

Figure 25:
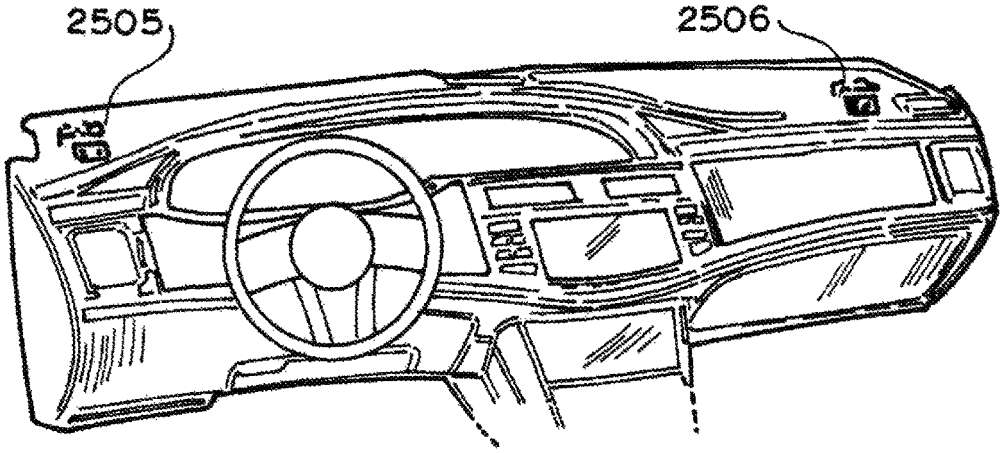
FIG. 25—is an isometric of a car dash containing two manifold speaker arrangements.

FIG. 25 shows the manifold speaker arrangement of FIG. 24 mounted inside the dash board of a car 2405 and 2506. This the only visual impact to the driver is the outlet array of the manifolds. This is a classic stereo arrangement.

Figure 26:
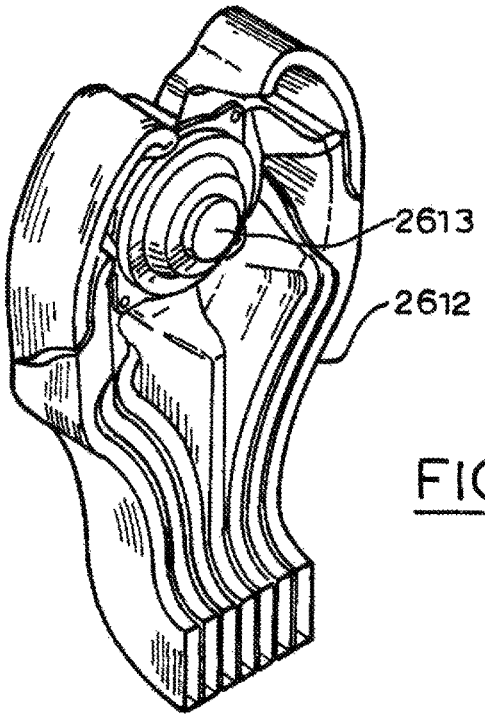
FIG. 26—is an isometric of a manifold speaker driver.

FIG. 26 shows manifold 2612 with the speaker driver 2613 mounted hard against its hard on collider. The profile of the dual arrangement is that both parts nest inside each other. The outlet is shaped as to suit the arrangement onto the back of a flat screen TV.

Figure 27:
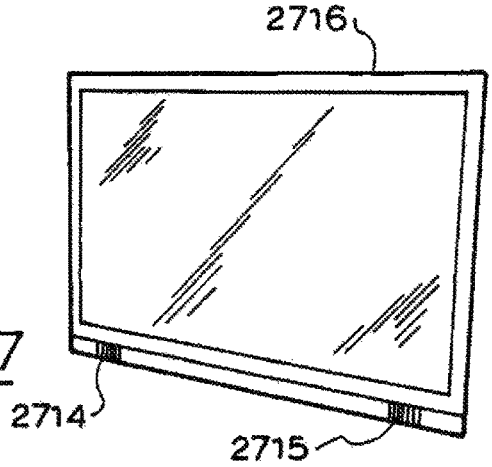
FIG. 27—is a front isometric view of a flat screen TV.
Figure 28:
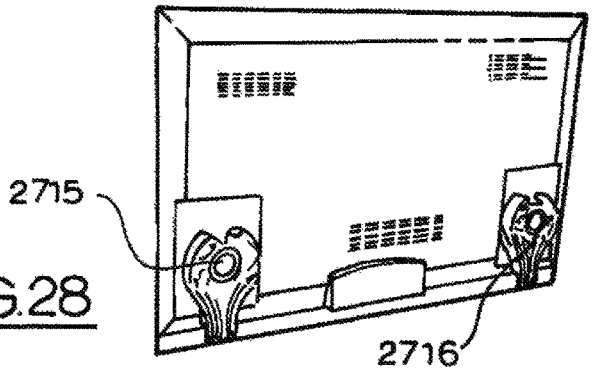
FIG. 28—is a rear isometric view of a flat screen TV.

FIG. 27 shows an isometric view of a flat screen TV 2716 with such an arrangement of FIG. 26 mounted into it. The outlets 2714 and 2715 are on the front surface of the TV 2716. FIG. 28 shows the rear isometric view of the flat screen. TV 2716 where manifolds 2714 and 2715 are visible. As manifolds 2714 and 2715 are made of plastic they may be injection moulded at the same time as the complete rear cover of the TV is moulded. This substantially reduces product costs.

Figure 29:
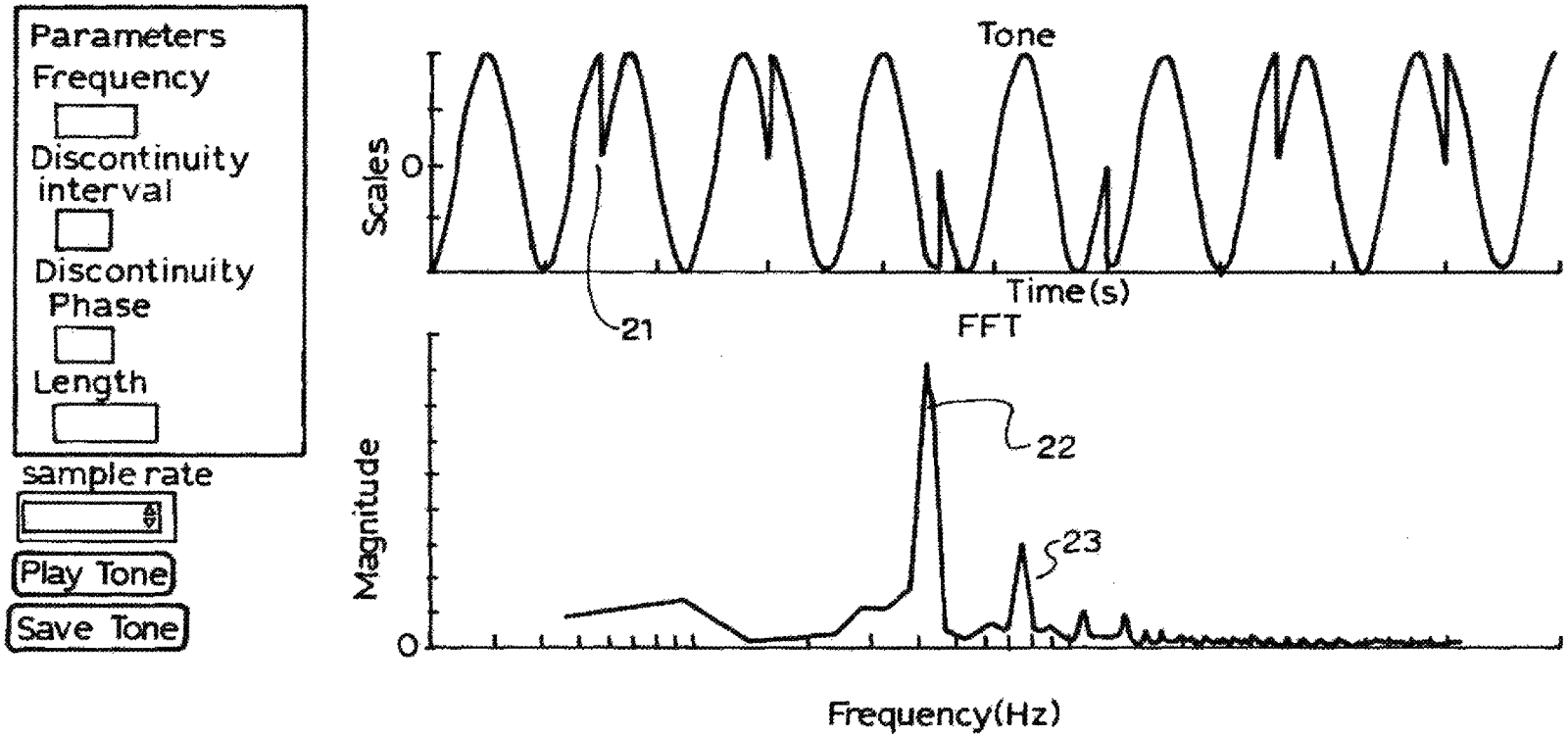
FIG. 29—is a graphical view of a tone and its Fast Fourier Transform.

FIG. 29 shows a constructed 'tone' consisting of a 500 Hz carrier. However at every 3 milliseconds a sudden 90 degree phase change occurs 21. The Fast Fourier transform shows that spectrally this is seen as a combination of approximately 410 Hz and 750 Hz components. However in this tone the 333 Hz being the 3 millines interval is dominant.

Figure 30:
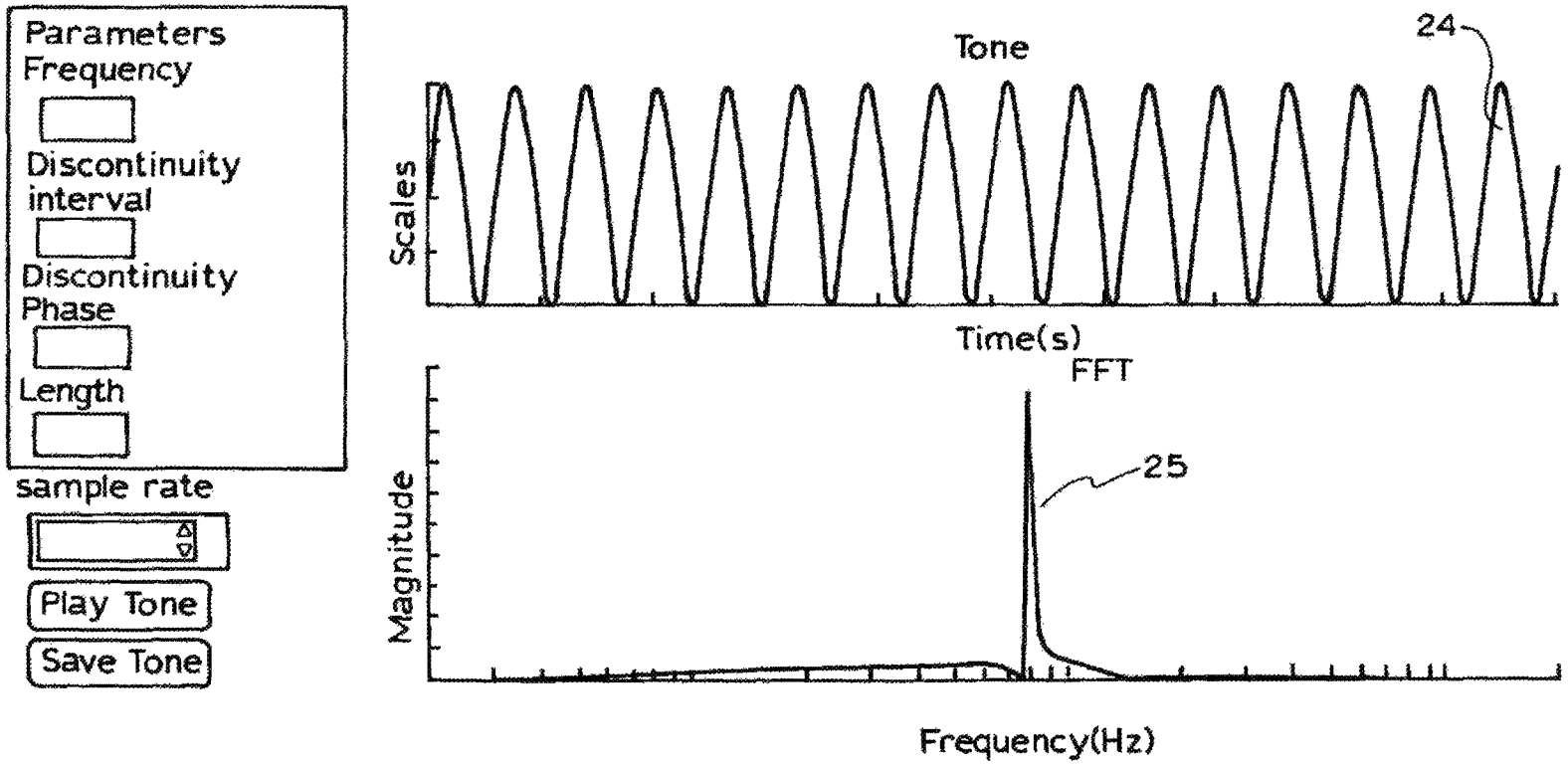
FIG. 30—is a graphical view of a tone and its Fast Fourier Transform.

FIG. 30 shows a constructed lone consisting of a 800 Hz carrier 24. The Fast Fourier transform shows that spectrally this is seen as 800 Hz only 25.

FIG. 31 shows a constructed lone consisting of a 800 Hz carrier and a small phase change (15 degrees) at 10 millisecond intervals 26. The Fast Fourier transform shows that spectrally this is still seen as 800 Hz only. however audibly the tone of 100 Hz can be heard due to the 10 millisecond phase changes. Smart phones are known to have little energy below 500 Hz to 700 Hz. The physical speaker driver cannot support tones below this region.

Figure 32:
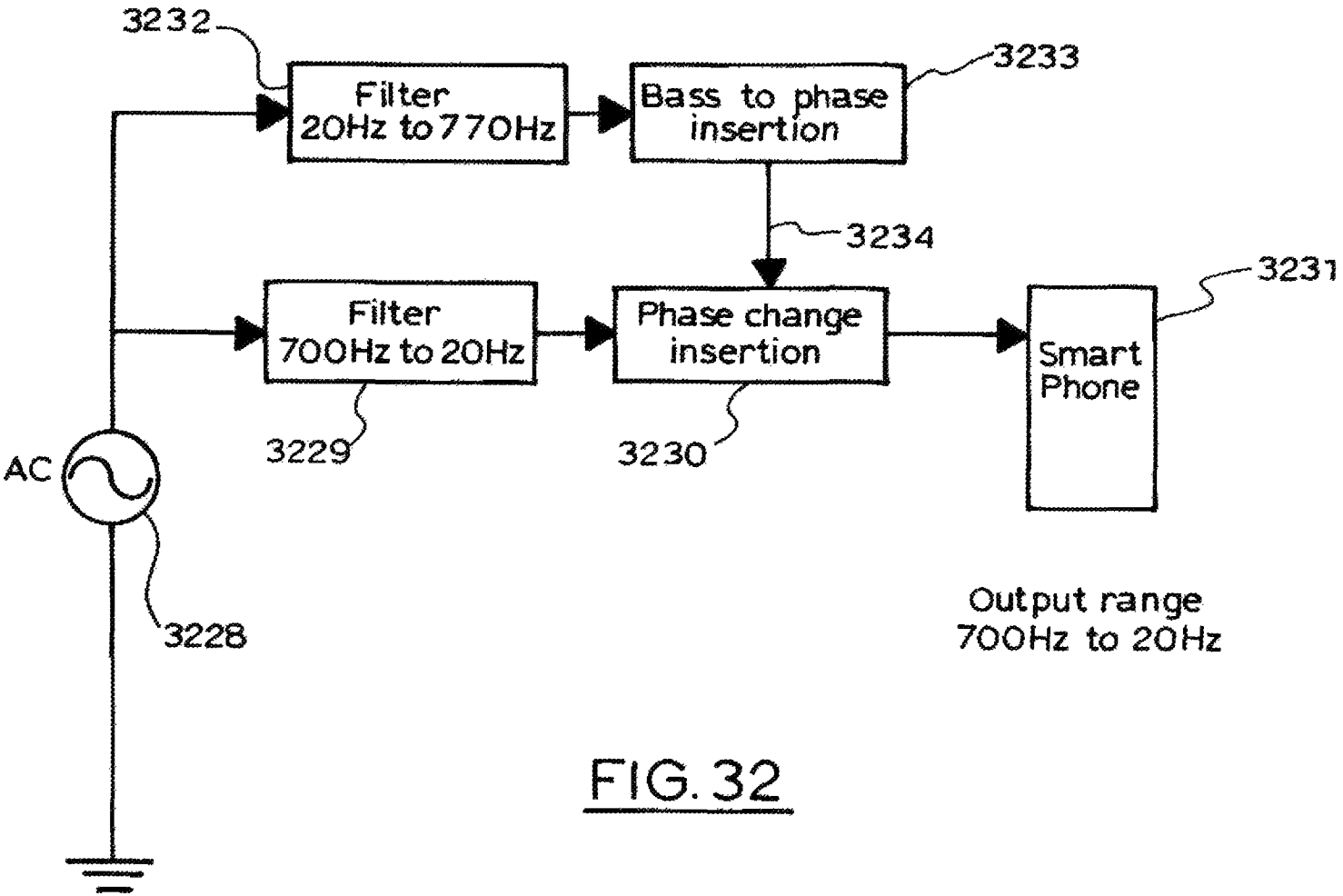
FIG. 32—is a schematic diagram of a system of sudden phase signal injection based on bass energy in the stop band of a loudspeaker.

FIG. 32 shows a system to insert bass into the pass band of a smart phone (700 Hz and above) by first splitting the audio signal into below (3232 and above (3229) 700 Hz components. The higher pass region 3229 is fed to the smartphone speaker 3231 after it passes through a phase modifier 3230, The lower portion of the audio signal 3231 is passed through a filter that extracts bass information and converts it into phase change on the pass band 3229 signal.

In this method bass is encoded as phase change into the above 700 Hz audio signal and becomes perceptible as bass through the human temporal perception systems.

Similarly other loudspeaker drivers suitable to other consumer electronic and industrial applications dimensions and power output can have an acoustical diffusion manifold designed which when coupled to that driver increase the resultant clarity, coverage, and imagery of the listening experience.

Other suitable number sequences are those used in signal processing such as a Barker code, a zero auto-correlation sequence or a complementary sequence The invention has been described with reference to specific embodiments. It will be apparent to those skilled in the art that various modifications may be made and other embodiments can be used without departing from the broader scope of the invention. For example, alternative forms of zero autocorrelation sequences or methods of achieving relative sequence element time delays may be used in the present invention. Therefore, these and other variations upon the specific embodiments are covered by the present invention.

The invention claimed is:

1. An acoustical diffusion manifold transducer system comprising:

an acoustic loudspeaker driver;

a manifold having:

a manifold inlet to which the acoustic loudspeaker driver is coupled, a surface defining a manifold outlet, and a plurality of acoustical pathways that each have an inlet end and an outlet end, the manifold being configured such that the inlet ends of the acoustical pathways are in communication with the manifold inlet, and the outlet ends of the acoustical pathways are arranged at the manifold outlet sequentially in an N×1 array, where N is the number of acoustical pathways and is also an odd prime number, wherein the length of each acoustical pathway is determined by an individual element solution to a Quadratic Residue Sequence that is multiplied by a pre-determined unit length, plus a pre-determined constant;

and wherein the individual element solutions to the Quadratic Residue Sequence are governed by the relationship:

$$S_n = n^2 \text{ rem } N, \text{ for } (0 <= n <= N-1),$$

in which n is the sequence element number.

2. An acoustical manifold transducer as claimed in claim 1 in which the manifold includes a splitter that separates acoustical energy from the acoustical loudspeaker driver at the manifold inlet into radially arranged inlet ends of the acoustical pathways.

3. An acoustical manifold transducer as claimed in claim 2 in which a cross sectional area of the manifold inlet is about the same as the total area of the outlet ends of the acoustical pathways.

4. An acoustical manifold transducer as claimed in claim 1 in which N is 7.

5. An acoustical manifold transducer as claimed in claim 2 in which the manifold is configured such that the manifold outlet of the acoustical pathways are oriented at an angle greater than a right angle from the manifold inlet.

6. An acoustical manifold transducer system as claimed in claim 5 fitted into a cell phone, vehicle dashboard or television screen support.

7. An acoustical manifold transducer as claimed in claim 2 in which N is 7.

8. An acoustical manifold transducer as claimed in claim 3 in which N is 7.

9. An acoustical manifold transducer as claimed in claim 7 in which the outlets of the acoustical pathways are oriented at an angle greater than a right angle from a hard on collider.

10. An acoustical manifold transducer system as claimed in claim 9 fitted into a cell phone, vehicle dashboard or television screen support.

11. An acoustical manifold transducer as claimed in claim 8 in which the outlets of the acoustical pathways are oriented at an angle greater than a right angle from a hard on collider.

12. An acoustical manifold transducer system as claimed in claim 1 fitted into a cell phone, vehicle dashboard or television screen support.

13. An acoustical manifold transducer as claimed in claim 1, wherein a cross sectional area of each acoustical pathway is substantially constant along it length.

14. An acoustical manifold transducer as claimed in claim 1, further comprising a twister portion within which one or more pairs of acoustical pathways swap positions laterally with respect to the N×1 array at the manifold outlet.

15. An acoustical manifold transducer as claimed in claim 1, wherein the outlet end of the acoustical pathway having the shortest length is located centrally within the N×1 array at the manifold outlet.

16. An acoustical manifold transducer as claimed in claim 1, wherein the outlet ends of the acoustical pathways having the longest lengths are located inwardly of the outermost outlet ends in the N×1 array at the manifold outlet.

* * * * *